United States Patent [19]

Rait et al.

[11] 3,993,484

[45] Nov. 23, 1976

[54] ELECTROSTATIC-MAGNETIC METHOD OF TRANSFERRING GRAPHICAL INFORMATION

[75] Inventors: Joseph M. Rait, Buffalo; Alexander Scott Gilmour, Jr., Williamsville; Edward C. Sellers, Buffalo; Robert L. Talley, New York, all of N.Y.

[73] Assignee: Canadian American Bank S.A., Luxembourg

[22] Filed: Sept. 24, 1973

[21] Appl. No.: 400,003

Related U.S. Application Data

[60] Division of Ser. No. 163,264, July 16, 1971, Pat. No. 3,804,511, which is a continuation-in-part of Ser. No. 59,185, July 29, 1970, abandoned.

[52] U.S. Cl. ..... 96/1.4; 96/1 R; 96/1.2; 101/426; 101/DIG. 13; 346/153; 346/157; 346/74.1; 355/3 R; 355/4; 427/18; 427/47

[51] Int. Cl.[2] ..... G03G 13/01; G03G 13/16; G03G 19/00

[58] Field of Search ..... 96/1 R, 1.4; 346/74 M, 346/74 MP, 74.1; 117/17.5, 234, 235, 239, 240; 427/18, 47; 101/426, DIG. 13

[56] References Cited

UNITED STATES PATENTS

| | | | |
|---|---|---|---|
| 2,857,290 | 10/1958 | Bolton | 346/74.1 X |
| 2,970,299 | 1/1961 | Epstein | 346/74.1 X |
| 3,043,685 | 7/1962 | Rosenthal | 346/74 MP |
| 3,093,039 | 6/1963 | Rheinfrank | 117/240 X |
| 3,106,607 | 10/1963 | Newell | 346/74.1 |
| 3,120,806 | 2/1964 | Supernowicz | 346/74.1 X |
| 3,161,544 | 12/1964 | Berry | 101/426 X |
| 3,185,777 | 5/1965 | Rheinfrank | 96/1.4 X |
| 3,401,394 | 9/1968 | Leonard et al. | 346/74.1 |
| 3,526,191 | 9/1970 | Silverberg et al. | 346/74.1 X |
| 3,547,029 | 12/1970 | Levine | 101/426 |
| 3,608,488 | 9/1971 | Levine | 101/426 |
| 3,653,066 | 3/1972 | Royse et al. | 360/4 |
| 3,846,591 | 11/1974 | Case | 117/239 X |
| 3,858,514 | 1/1975 | Beebe et al. | 101/426 |

FOREIGN PATENTS OR APPLICATIONS

| | | | |
|---|---|---|---|
| 1,815,680 | 8/1969 | Germany | 346/74 M |

*Primary Examiner*—Roland E. Martin, Jr.
*Assistant Examiner*—John R. Miller
*Attorney, Agent, or Firm*—Christel & Bean

[57] ABSTRACT

An electrostatic image of graphical information is formed on a surface, for example that of an endless tape, a drum or suitable paper, and then magnetic toner particles are applied to the surface and adhere thereto in correspondence with the electrostatic image. Portions of the same surface, in the case of the tape, or of another surface, when the drum or paper are employed, are magnetized, as determined by the location of the toner prticles, to form a magnetic image corresponding to the electrostatic image. Then the toner medium are transferred by friction to a copy mdium such as ordinary paper, while the magnetic image is retained or stored on the surface. Toner particles then again can be applied to the magnetic image for production of additional copies. In other embodiments, magnetic material located on a surface in correspondence with graphical information, such as a hard copy comprising magnetic toner particles fixed to a paper substrate, is utilized in magnetizing a surface such as that of a drum or an endless tape, to form a magnetic image of the graphical information. The magnetic image can have toner particles applied thereto for photocopying by transfer to a copy medium such as paper, or it can be scanned to generate a sequential electrical signal indicative of the graphical information which signal is compatible with computer forms of storage and processing.

20 Claims, 20 Drawing Figures

ELECTROSTATIC-MAGNETIC METHOD OF TRANSFERRING GRAPHICAL INFORMATION

CROSS REFERENCE TO A RELATED APPLICATION

This application is a division of application Ser. No. 163,264 filed July 16, 1971 entitled "Method and Apparatus Utilizing Magnetic Storage For Transferring Graphical Information", now U.S. Pat. No. 3,804,511, which is a continuation-in-part of our copending application Ser. No. 59,185 filed July 29, 1970 entitled "Method And Apparatus Utilizing Magnetic Storage For Transferring Graphical Information" and now abandoned.

BACKGROUND OF THE INVENTION

This invention relates to the transfer of graphical information and, more particularly, to a method and apparatus utilizing magnetic storage for transferring graphical information.

In photocopying, graphical information is transferred from an original medium to a copy medium one or a number of times depending upon the number of copies desired. Many prior art photocopying processes include optical scanning of the original to create an electrostatic image on a surface, such as the surface of a drum or a plate having a layer of photoconductive insulating material affixed to a conductive backing for supporting electrostatic images. The surface is electrostatically charged and then exposed to a light pattern of the image being reproduced. The electrostatic image thus formed is developed by applying to the surface a powder known as toner which is attracted to the electrostatic image to produce a visible powder image. Then the particles are transferred and fixed to a copy medium such as paper in correspondence with the visible image.

A significant problem with present photocopying methods and apparatus is the volatility of the image formed therein, in other words the image is lost in the transfer step to the copying medium. An immediate consequence is the need to successively scan the original and form another image for each copy to be made. In addition to increasing the complexity and cost of the apparatus, this limits the speed of operation when a number of copies are to be made. Furthermore, this also requires that the original be retained in the apparatus for the duration of the copying operation which may be undesirable when a large number of copies is to be made. Another problem with many present photocopying methods and arrangements is the need to use a particular kind or otherwise specially treated paper for the copies as opposed to readily available ordinary types of paper.

In recent times there has developed an increasing need for apparatus capable of reversably transferring graphical information from a conventional hard copy to and from a computer for storage and/or processing. The interface of graphical information with computer usage requires optical scanning of the hard copy, electronic processing of the electrical output information and final storage of this information in the computer system.

Apparatus heretofore available is extremely expensive and complex, such as known arrangements including cathode ray tubes and associated systems, in addition to lacking flexibility in many instances.

SUMMARY OF THE INVENTION

It would, therefore, be highly desirable to provide a method and apparatus which when used in photocopying forms an image which is permanent, not volatile, which can be retained therein for as many copies as desired and whereby the original can be removed from the apparatus prior to the end of the copying operation. Such a method and apparatus would be desirable where, in addition, after a first stage or cycle of the copying operation, the subsequent cycles for making additional copies can be performed at a relatively higher speed. Furthermore, it would be highly desirable to provide such a method and apparatus which can make copies on ordinary paper and which is readily adaptable to making colored copies. It would also be desirable to provide a method and apparatus for transferring graphical information to and from a computer which method and apparatus is relatively simple and inexpensive yet highly efficient and flexible in operation.

The present invention provides a method and apparatus for transferring graphical information wherein, in some embodiments thereof, an electrostatic image of the graphical information is formed on a surface and then magnetic toner particles are applied to the surface and adhere thereto in correspondence with the electrostatic image. Portions of the same or another surface are magnetized, as determined by the location of the toner particles, to form a magnetic image corresponding to the electrostatic image. Then the toner particles are transferred to a copy medium while leaving the magnetic image on the surface whereby additional copies can be made. In other embodiments thereof, the present invention provides a method and apparatus wherein magnetic material located on a surface in correspondence with graphical information is utilized in magnetizing a surface to form a magnetic image of the graphical information. Magnetic toner particles can be applied to the image and then transferred to a copy medium while leaving the magnetic image whereby additional copies can be made. Alternatively, the magnetic image then can be scanned to generate a sequential electrical signal indicative of the graphical information which signal is compatible with computer forms of storage and processing.

The foregoing and additional advantages and characterizing features of the present invention will become clearly apparent upon a reading of the ensuing detailed description together with the included drawing wherein:

DETAILED DESCRIPTION OF THE ILLUSTRATED EMBODIMENTS

Figure 1:
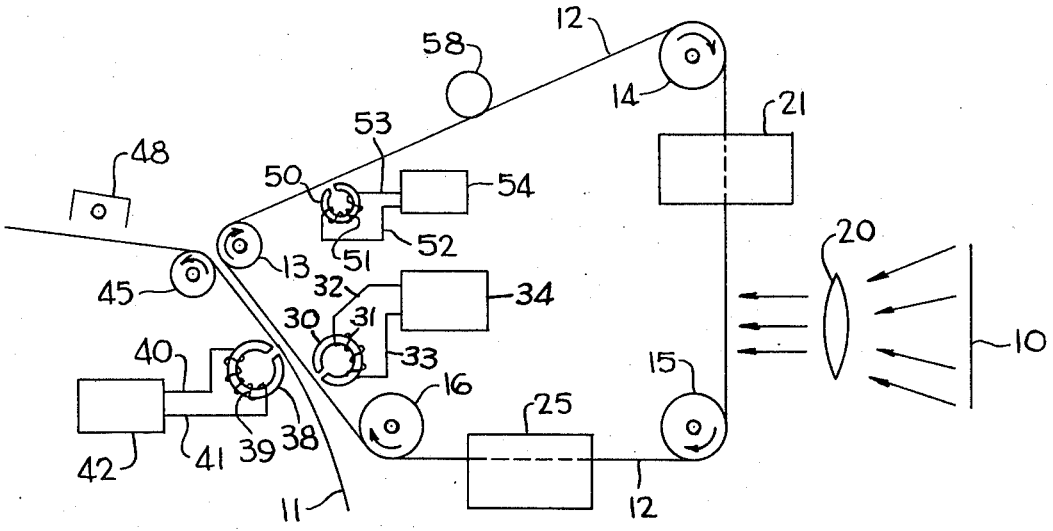
FIG. 1 is a diagrammatic view of a method and apparatus for transferring graphical information in photocopying according to one embodiment of the present invention.

FIG. 1 illustrates a method and apparatus according to a first embodiment of the present invention for transferring graphical information from an original medium such as a document, designated generally at 10, to a copy medium such as a paper shown at 11. The apparatus comprises a recording means which is magnetizable and capable of supporting an electrostatic image. In this embodiment of the present invention the recording means comprises an orbitally movable magnetically retentive member capable of surface magnetization in the form of tape 12. In preferred form tape 12 comprises a suitable base or substrate having a coating of iron oxide and zinc oxide and possibly a thin overcoat of suitable material as will be described in detail hereafter. The endless tape 12 is trained around four supporting rollers, 13, 14, 15 and 16 which define an orbit for tape 12. Rollers 13–16 together with suitable drive means (not shown) to which they are coupled comprise a motive means for causing relative displacement between tape 12 and the other elements of the apparatus of the present invention which now will be described.

An optical image of the graphical information from original medium 10 is transformed to an electrostatic image on recording means or tape 12 by a lens 20 which directs light rays from medium 10, which would be illuminated, onto the surface of tape 12 and by an electrostatic charging unit 21 which operates on tape 12 prior to its reception of light rays from the medium 10. In particular, charging apparatus 21 operates in a conventional manner to charge the zinc oxide layer of tape 12 by using about minus 5000 volts to place a negative charge on the outer surface of tape 12, as it is viewed in FIG. 1, and by using about plus 5000 volts to place a positive charge on the inner surface of tape 12. Charging apparatus 21 is conventional in form and being readily commercially available and well known to those skilled in the art, a detailed description thereof is deemed unnecessary. In addition, when more than one copy is to be made, charging apparatus 21 operates only during production of the first copy as will be described in detail hereafter. The electrostatically charged tape 12 is moved past the image of light rays directed through lens 20 from the original 10 and in synchronism with the scan of original 10. When the light rays reach the outer surface of tape 12 the high light level portions of the image discharge the zinc oxide while the portions of the tape contacted by the low light level portion of the image remain charged. An electrostatic image thus is formed on tape 12 and this image formation likewise is required only during production of the first of a number of duplicate copies as will be described hereafter.

The apparatus of the present invention further comprises means, designated generally at 25 in FIG. 1, for applying magnetic toner particles to the recording means, in particular to a surface of tape 12, in a manner such that the particles adhere to the recording means in the form of an image corresponding to the image already present thereon. The toner particles, as they are known in the art, are in the form of a pigmented powder which when applied to tape 12 provides a powder image by means of adherance or attraction to the electrostatic image. The toner particles used in the method of the present invention have both an electrostatically attractive component and a magnetic component. They also have a resinous component to facilitate subsequent fixing to the copy medium. One form of magnetic toner particles found to perform satisfactorily are available commercially under the name Tribofax No. 213 electrostatic imaging material and manufactured by the Surface Processes Corporation of Pennsylvania. The means designated 25 for applying the magnetic toner particles to tape 12 is representative of various toner applying arrangements known in the art which may be employed in the apparatus of the present invention. In addition, two specific examples of toner applying means 25 will be described in detail further on in the specification.

The apparatus of the present invention further comprises magnetic image forming means operatively associated with the recording means for magnetizing the recording means as determined by the location of the toner particles on the recording means to form a magnetic image corresponding to the electrostatic image. In the embodiment of FIG. 1 those portions of a surface of tape 12 on which the toner particles are adhered are magnetized. The magnetic image forming means comprises magnetizing means in the form of a recording head including a core 30 around which is wound a coil 31 connected by leads 32 and 33 to a source of magnetizing current 34. Core 30 of the magnetizing means is positioned relative to tape 12 so as to operate thereon after toner particles are applied by the apparatus 25 to tape 12. In addition, core 30 is positioned in the apparatus so that the magnetizing means applies a continuous magnetizing current to tape 12 in a direction, as viewed in FIG. 1, from the inner surface thereof through the tape 12. Source 34 provides a periodic, such as sinusodial or pulsed, signal for driving the recording head, the frequency depending upon the degree of resolution desired for the recording, whereby a continuous uniform magnetic recording is placed on tape 12.

By way of illustration, a core 30 was employed having a diameter of about one-half inch, a thickness in the range of 0.010–0.020 inches and a gap length of approximately 0.001 inch. Coil 31 was wound to provide six to ten ampere turns. To achieve the desired degree of resolution in the recording and resulting copy, it was found that lines spaced by no more than three or four mils should be placed on the tape 12. With tape 12 having a thickness of about two mils it was found that a line spacing of about three mils was about as small a spacing that could be achieved using a conventional recording head driven by a sinusodial signal. Tape 12 was moved orbitally at a speed of about three inches per second in this illustrative example, and the frequency of the recording signal provided by source 34 was about 1000 cycles.

The magnetic image forming means further comprises demagnetizing or magnetic erasing means in the form of a core 38 around which is wound a coil 39 which, in turn, is connected through leads 40, 41 to a source 42 of demagnetizing or erasing current. Core 38 is positioned in the apparatus to operate on tape 12 after operation of the magnetizing means and to apply a demagnetizing or erasing current to tape 12 in a direction from the other surface thereof through the tape. As a result, the toner particles adhered to the surface of tape 12 provide a magnetic shunt thereby resulting in selective erasing of tape 12 to form a magnetic image corresponding to the electrostatic image as will be described in detail hereafter. The travel of the copy medium or paper 11 between tape 12 and erase head 38 prevents the toner on tape 12 from being smeared by core 38 and also maintains a uniform spacing between core 38 and tape 12. A small pressure pad (not shown) may be positioned at the surface of tape 12 opposite core 38 and in alignment therewith to insure that paper 11 and tape 12 remain in contact with core 38. In addition, the demagnetizing means erase head including core 38 may be pivotally mounted so that it can be moved away from tape 12 when the leading edge of a sheet of paper 11 is approaching. The demagnetizing means or selective erase head is energized only during the first cycle of operation producing the first copy when multiple copies are to be made. Although source 42 can provide either a.c. or d.c. exitation of the erase head, alternating current at a frequency of approximately 100 kilocycles has been found to provide desirable results. In addition, the amplitude of the signal provided by the erase head should be closely regulated.

The apparatus of the present invention further comprises transfer means for transferring the toner particles from the recording means or tape 12 to the copy medium such as paper 11. By virtue of the arrangement of the present invention, a copy of the original is made and the magnetic image remains on the recording means or tape 12 for the production of additional copies. Referring now to FIG. 1, the transfer means comprises a roller 45 drivenly coupled to a suitable drive means (not shown) which roller 45 is in close proximity to and in operative association with roller 13. Rollers 13 and 45 rotate in opposite directions and press or urge tape 12, i.e. the surface of tape 12 on which the toner particles are present, into intimate contact with paper 11. As a result, the toner particles on tape 12 are transferred by friction to the paper 11. This frictional transfer process is believed to be enhanced by the porosity of the paper surface which serves to collect the toner particles. Furthermore, it has been found that virtually all of the toner particles on tape 12 can be transferred by this process. The rollers 13 and 45 preferably should have hard outer surfaces and should be spring loaded toward their respective positions.

After paper 11 has received the toner particles it is transferred to a conventional fusing unit indicated generally at 48 in FIG. 1 for fixing the toner particles to the paper 11. Unit 48 is representative of various types of conventional fusing units which, briefly, function to apply heat as by way of a lamp to the toner particles thereby fusing or permanently bonding them to the copy medium. The resinous component of the particles provides the bond between the particles and paper. The recording means or tape 12 is passed in proximity to a demagnetizing means or magnetic erase head which operates on the tape when the magnetic image or recording thereon is no longer needed. In this particular illustration a core 50 is positioned near tape 12 and has wound thereon a coil 51 which is connected through leads 52 and 53 to a source of demagnetizing or erase current 54. Source 54 would be operated selectively to energize the erase head only when the magnetic image on tape 12 is to be removed such as when only one copy is wanted or after a desired number of copies has been produced. Alternatively, the magnetic erasing means can comprise simply a permanent magnet mechanically coupled to a means for moving it into and out of proximity with tape 12. Residual toner particles are removed from the recording means or tape 12 by means of a roller 58 provided with an outer surface of felt and which is continually cleaned.

To perform the method of the present invention the apparatus shown in FIG. 1 operates in the following manner. There is formed an electrostatic image of input graphical information from the original medium 10, such as a document, on a surface of recording means of tape 12 which is magnetized and capable of supporting electrostatic images. The zinc oxide layer on tape 12 is charged by unit 21 as previously described and light rays from the original 10, which is illuminated, are directed by lens 20 toward the charged surface of tape 12. Tape 12 is moved across the image of the light rays in synchronism with the scan of the original 10. In other words, the original 10 is scanned by relative movement between it and a light source as in conventional photocopying, and tape 12 is caused to travel past the optical image directed by lens 20 in synchronism with this scanning. The portions of the image having a high light level or intensity discharge the zinc oxide on the surface of tape 12 while those portions of the surface receiving the low light level or intensity portions of the image remain charged. An electrostatic image thus is formed on the surface of the recording means or tape 12 in correspondence with or as a duplicate of the optical image received from the original 10.

Magnetic toner particles are applied to a surface of the recording means, the same surface of tape 12 on which the electrostatic image is present, in a manner such that the particles adhere to the surface of the recording means in correspondence with the electrostatic image. Tape 12 is moved through its orbit by operation of the rollers 13–16 whereby the portion thereof on which the electrostatic image is present passes through the toner applying apparatus 25. The toner particles as previously described include an electrostatically attractive component whereby the particles are attracted to the electrostatically charged portions of the surface of tape 12. Upon leaving the apparatus 25, the surface of tape 12 has a powder image thereon provided by the toner particles in correspondence with and as a duplicate of the electrostatic image. For convenience in illustration it is noted that in this particular example the toner particles are adhered to the outer or lower surface of tape 12 as it is viewed in FIG. 1. The next step, according to the method of the present invention, is magnetizing portions of a surface of the recording means, as determined by the location of the toner particles on the recording means, to form a magnetic image corresponding to the electrostatic image. According to this embodiment of the present invention, tape 12 is magnetized on portions of the surface thereof on which the toner particles are adhered. The step of magnetizing is performed by first applying a continuous magnetizing current to tape 12 in a direction from the inner surface thereof, as viewed in FIG. 1, through the tape. Source 34 delivers a periodic current at a frequency preferably of about 1000 cycles to coil 31 and core 30. A continuous uniform magnetic recording thus is placed on tape 12. According to the foregoing example with tape 12 having a thickness of about 2 mils and moved past core 30 at a speed of about three inches per second, there was provided a recording having a line spacing of about three mils when the frequency of the recording signal was 1000 cycles. Core 30 is sufficient in length to extend across the width of tape 12.

The step of magnetizing to form a magnetic image is then completed by applying a demagnetizing or magnetic erasing signal to tape 12 and in a direction from the outer surface thereof as viewed in FIG. 1 through the tape. The outer surface is the surface of tape 12 on which the toner particles are present. As a result, the toner particles which adhere to the tape 12 by electrostatic attraction provide a magnetic shunt thereby causing selective erasing of tape 12 to form a magnetic image corresponding to or duplicating the electrostatic image. During this step as will be noted from an inspection of FIG. 1, a copy medium or paper 11 is passed between the selective erase head or core 38 and tape 12 and at the same speed or rate of travel as that of tape 12 to prevent the toner on tape 12 from being smeared by core 38 and to insure that the spacing between the erase head and tape 12 remains uniform.

After the step of forming the magnetic image has been performed, the recording means or tape 12 has on a surface thereof a powder image formed by the toner particles in correspondence with the image of the original 10 and a magnetic image on the surface which is an exact duplicate of the powder image and in this particular illustration on the same surface of tape 12 directly under the toner particles. The next step in the method of the present invention is transferring the toner particles from the recording means or tape 12 to a copy medium, here paper 11, while leaving the magnetic image on the recording means or tape 12. This is performed by passing tape 12 and paper 11 between rollers 13 and 45 resulting in frictional transfer of the toner particles to paper 11 as previously described. Paper 11 then has toner particles thereon in an exact image of the graphical information from copy medium 10, and the particles are permanently fixed or fused to paper 11 by means of the fusing apparatus indicated at 48 in FIG. 1. Paper 11 thus has on the surface thereof an exact copy or reproduction of the graphical information on the original 10.

One significant advantage of the method and apparatus of the present invention is that the copy medium can be any readily available paper such as ordinary bond paper. The copy medium does not have to be a specially treated paper as is required in many prior art photocopying processes and apparatus. The magnetic image remains on tape 12 after transfer of the toner particles to copy medium 11. The image formed thus is not volatile, i.e. not lost in the transfer to copy medium 11, thereby providing another significant advantage of the present method and apparatus. The retained or stored magnetic image is utilized for the production of additional copies which production can be performed at a higher speed than that of the first copy and with the original 10 removed from the apparatus. Referring now to FIG. 1 and assuming that additional copies are to be made, tape 12 continues through another orbit, with the erase head 50 not being energized or, in the case of a permanent magnet, not being in close proximity to tape 12. Charging apparatus 21 is rendered inoperative by suitable control means and no scanning of the original 10 is performed. As tape 12 enters the toner applying apparatus 25 it has the magnetic image thereon which attracts toner particles while in the apparatus 25. This is because the toner particles have a magnetic component. As the tape 12 leaves the apparatus it thus has a powder image formed thereon which is identical to the powder image formed thereon during the first cycle. The recording and erase heads 30 and 38, respectively, are not energized during this or subsequent cycles, and transfer of the toner particles to paper 11 is performed as paper 11 and tape 12 are passed between rollers 13 and 45 as before. The toner particles then are fused to the paper by apparatus 48, and tape 12 with the magnetic image thereon can be moved through identical successive cycles for a number of times equal to the number of desired copies. Because there is no need to optically scan the original 10 to produce an electrostatic image after the first copy is produced, the subsequent copies can be generated at a relatively higher speed or rate. After that, erase head 50 is energized from source 54 to remove the magnetic image for the start of a new cycle with a new original 10 to be copied. The apparatus would include, in addition, a suitable control system for deactivating the magnetizing means 30, 38, erase head 50, charging unit 21 and scanning means during production of additional copies as well as for operating these components during production of the first copy. In addition, there would be provided controlled means for feeding copy media or paper sheet through the apparatus successively as in conventional photocopying apparatus.

According to this embodiment of the invention, tape 12 preferably comprises a base or substrate or suitable material having a coating of iron oxide and zinc oxide. The base or substrate material must have enough electrical conductivity to allow passage therethrough of electrical charges placed on the exposed surface of the base by charging apparatus 21 to the other surface of the base which is nearer the zinc oxide layer. In particular, one form of tape 12 found to operate satisfactorily consisted of a substrate having a thickness of 0.001 inch coated with either a 0.0005 inch layer of gamma iron oxide overlaid by a 0.0005 inch layer of zinc oxide or a 0.001 inch layer of a mixture including 30 percent by weight of gamma iron oxide and 70 percent by weight of zinc oxide. In addition, an overcoating of suitable, slightly conductive, material having a thickness of about 100 microinches can be provided, being laminated over the iron oxide and zinc oxide matrix. The width of tape 12 is determined by the size of the copies to be made, and in one example, tape 12 was about 9 inches wide by about 16 inches long.

It has been found that in the embodiment of FIG. 1, the amplitude of the erase current or signal delivered by source 42 to energize coil 39 and core 38 should be closely regulated, perhaps to better than one percent. It also was found that when tape 12 included a zinc oxide layer over the iron oxide layer, the separation between the magnetic toner particles and the iron oxide caused by the zinc oxide layer apparently can reduce the shielding effect of the toner. For this reason, the thickness of the zinc oxide layer should be minimized or else, in the alternative, a zinc oxide, iron oxide matrix or mixture should be employed.

In the foregoing method of the present invention, after magnetic tape 12 is uniformly recorded at a frequency in the range from 500 to 1000 cycles by the recording head comprising core 30 and coil 31, the recorded tape 12 and an image in the form of a shield pattern are passed by an erase head comprising core 38 and coil 39. The shield pattern, of course, is provided by the powder image formed by the toner particles in correspondence with the image of the original 10 adhered to tape 12 by electrostatic attraction. As pointed out hereinabove, the purpose of the shield pattern which is located between the erase head and magnetic tape 12 is to prevent erasure of tape 12 in some areas, thereby leaving a magnetic image on tape 12. It is important that sufficient contrast and resolution exist in the resulting magnetic image so that acceptable copies can be made from tape 12. In other words, as tape 12 is moved from those areas to be erased to those areas where an appreciable signal should remain, an acceptable contrast level should be produced. This in turn, determines how much shielding must be provided by the shield pattern.

It has been determined that at least a 50 percent decrease in the erase field must be caused by the shield pattern for an adequate contrast level to be achieved. By way of specific example, the signal level remaining on three different magnetic tapes was determined as a function of the voltage applied to the erase head comprising core 38 and coil 39. The three tapes had coating thickness of 0.55, 0.38 and 0.20 mils and coercivities of 275, 300 and 290 oersteds, respectively. First, the tapes were passed by the recording head comprising core 30 and coil 31 to which a current of 100 milliamperes was applied, with a zinc oxide paper providing a spacing of about three and one-half mils between the magnetic tape and the recording head. With a voltage level of 70 volts at about 160 kilocycles applied to the erase head, it was found that sufficient magnetization remained on these tapes to permit them to make black patterns on white paper with acceptable contrast. With the erase voltage increased to approximately 140 volts at the same frequency, all three magnetic tapes were effectively erased so that they could not pick up magnetic toner particles. Based on the assumption that the magnetic field produced by the erase head was proportional to the voltage applied to the head, it was determined that a shield pattern must be capable of producing at least a 2:1 change in the erasing magnetic field that is applied to the magnetic tape for an acceptable contrast level to be produced.

The effectiveness of various shield characteristics was examined in terms of providing the required 50 percent decrease in the erase field. In particular, a mathematical solution was developed for the magnetic flux density distribution in a region including closely-spaced pole pieces, paper, magnetic toner particles, and ferric oxide coated magnetic tape. From this solution the following results were obtained.

Figure 13:
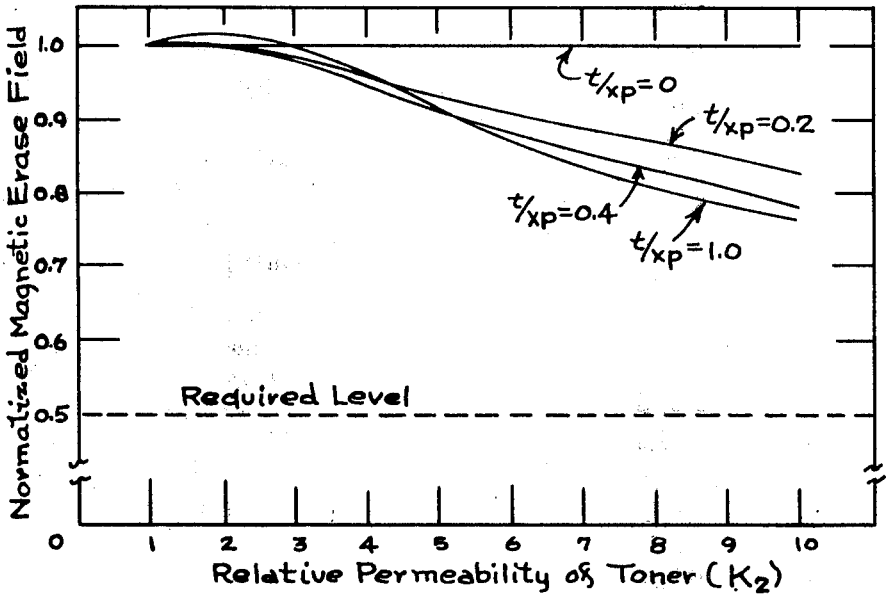
FIG. 13 is a graph illustrating an aspect of the method and apparatus of FIG. 1.

The flux density of the magnetic erase field is changed by a factor of two when the ratio of the thickness of the toner to the thickness of the paper, $t/x_p$, changes from 0 to 1. In other words, the desired contrast in the magnetic image remaining on the tape could be achieved without using a high permeability magnetic toner material if $t/x_p$ could be made to change from zero to one. This can be seen in detail be referring first to FIG. 13 which is a graph showing the effect of relative permeability of the toner ($K_2$) on the magnetic erase field for various values of the thickness of the toner. The field strength values are normalized with respect to the value when $K_2$ is 1.0. Even for a toner thickness of $t/x_p$=1.0 an increase in the relative permeability of the toner from 1 to 10 only produces a 24 percent decrease in the level of the erasE magnetic field. The required level of field to achieve the desired contrast is indicated by the broken line, and the relative permeability of the toner must be approximately 20 if this reduction in the field is to be achieved. This result was obtained for the situation where the tape always remains at the same distance from the magnetic pole piece and where the relative permeability of the ferric oxide is 4 and the ratio of thickness of the ferric oxide to the thickness of the paper is 0.1.

Figure 14:
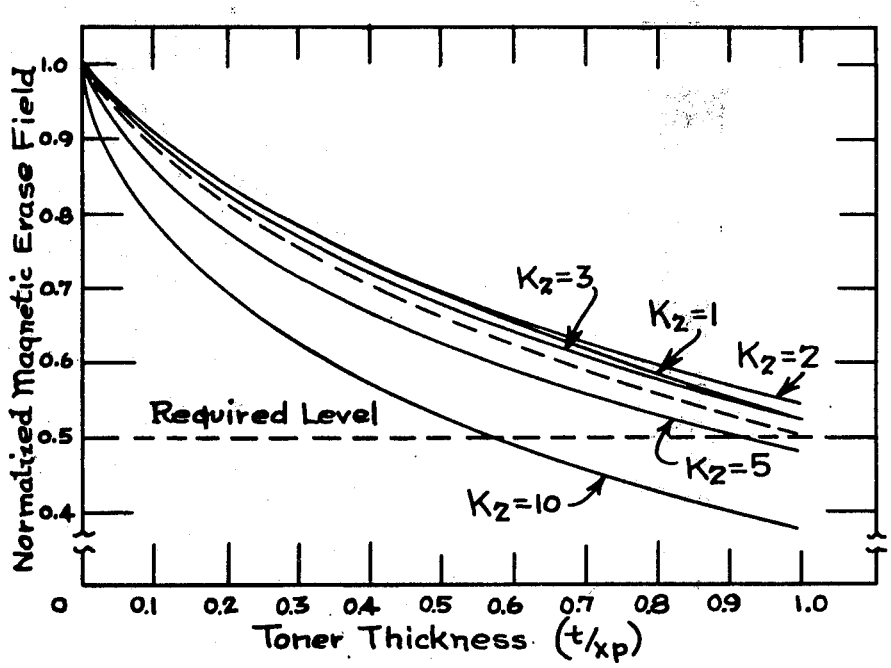
FIG. 14 is a graph illustrating another aspect of the method and apparatus of FIG. 1.

FIG. 14 is a graph showing the effect of toner thickness ($t/x_p$) on the magnetic erase field for various values of the relative permeability of the toner ($K_2$). The field strength values are normalized with respect to the value when $t/x_p$ is zero. The required level of erase field to achieve the desired contrast is indicated by the broken line. Thus for values of relative permeability of the toner in the range of 1 to 3, a 50 percent field reduction is predicted for values of $t/x_p$ near 1.0 to 1.1. With the relative permeability of the toner being 5, the required value of $t/x_p$ is 0.9, and for a permeability of 10 the required value of $t/x_p$ is 0.56. Thus the 50 percent erase field decrease can be accomplished with non-magnetic or low permeability magnetic toners if the ratio of the thickness of the toner to the thickness of the paper can be made to equal or exceed 1.0. If the relative permeability of the toner can be made as high as 10, then $t/x_p$ can be as low as 0.56.

It has been determined that for the effective permeability of the toner to be in the range from 10 to 20, the magnetic particles in the toner must be shaped and aligned so that 90 to 95 percent of the length of a strip of the toner is filled with high permeability material. By effective permeability it is meant that the toner is considered in bulk form, taking into account the non-magnetic materials present together with the voids or air spaces between particles. In achieving these conditions, it is necessary to determine whether or not saturation of the magnetic particles will occur. With spherical toner particles, the flux density inside never exceeds three times the flux density that was present before the particle was placed in the field. It is unlikely, therefore, that saturation will occur. With elongated or needle-shaped particles aligned with the field, the density inside the particle would be much greater than three times the density outside the particle. Therefore, saturation of these needle-shaped particles can occur at relatively lower flux densities.

Referring to FIG. 14 it is seen that by varying the ratio of the thickness of the toner to the thickness of the paper ($t/x_p$) between 0 and about 1.0 for relative permeabilities in the range of 1 to 5 or between 0 and about 0.56 for relative permeabilities of about 10, the required reduction in field strength for acceptable contrast is achieved. Thus any variation in the thickness of the toner or the thickness of the paper, alone or in combination, causing the aforementioned variation in the ratio $t/x_p$ will provide the desired result. This can be the basis for a modulation type erasing scheme wherein, for example, paper embossed in accordance with the graphical information to be transferred is employed to provide the required variations in the thickness of the paper. Alternatively, the same variations in the ratio could be achieved by a modulation scheme which would vary the thickness of the toner in accordance with the graphical information to be transferred. The difference in the electrostatic charge levels corresponding to low and high light level portions of the optical image would be regulated. In addition, magnetic toner particles having the required degree of electrostatic attraction would be selected. As a result, the difference in toner thickness between high and low light level portions of the image would be sufficient to provide the desired variation in the ratio $t/x_p$ and, hence, the required reduction in field strength.

Figure 2:
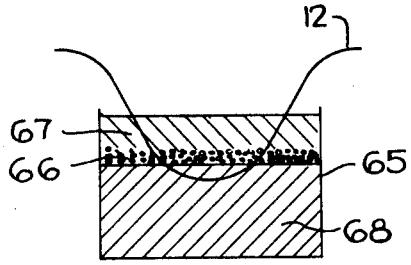
FIG. 2 is a diagrammatic view, partly in section, of one arrangement for applying toner particles in the method and apparatus of FIG. 1.
Figure 3:
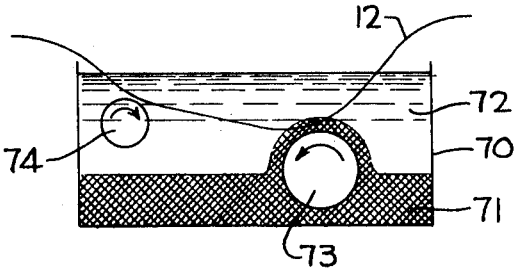
FIG. 3 is a diagrammatic view, partly in section, of another arrangement for applying toner particles.

FIGS. 2 and 3 illustrate in detail two arrangements for applying toner particles to tape 12 as provided by the apparatus indicated at 25 in FIG. 1. Referring now to FIG. 2, a container 65 includes a mixture of the magnetic toner particles, here designated at 66, and kerosene 67 floated on water 68. The magnetic toner particles 66 are dispersed in the kerosene and become concentrated at the bottom of the kerosene at the interface with the water 68. The tape 12 is moved through the dispersed mixture and then passed through a kerosene rinse to remove excess toner particles. In FIG. 3 a container 70 includes a mixture of toner particles 71 and kerosene 72, the toner particles settling to the bottom of container 70 to form a high density collection thereof. A first roller 73 functions to bring the mixture into contact with the tape, especially the high density toner particles 71, and a second roller 74 will be provided for rinsing tape 12 with the kerosene. Other methods and apparatus can be employed to apply toner particles in either wet or dry form to tape 12. The requirement is that the toner particles must be applied to tape 12 with equal efficiency when it is electrostatically charged and when it is magnetized. That is, during production of a first copy tape 12 as it passes through the apparatus indicated at 25 in FIG. 1, is electrostatically charged. On the other hand, on successive cycles for the production of additional copies, tape 12 is magnetized with the magnetic image thereon as it passes through the apparatus 25.

Figure 4:
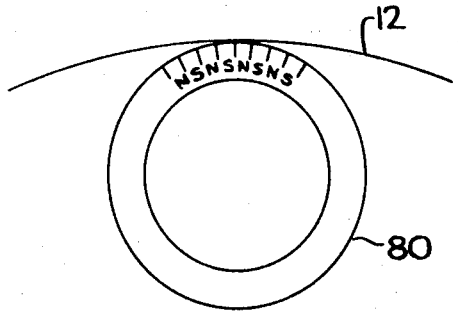
FIG. 4 is a side elevational view of a magnetic recording head which alternatively can be employed in the method and apparatus of FIG. 1.
Figure 5:
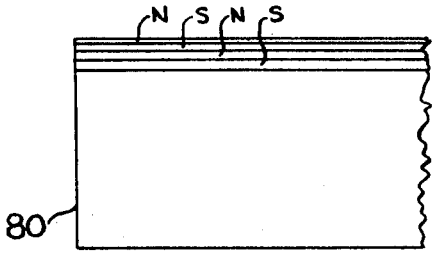
FIG. 5 is a side elevational view of the recording head in FIG. 4.

FIGS. 4 and 5 illustrate a magnetic recording element which can be employed in the apparatus of FIG. 1 in place of coil 30, winding 31 and source 34. The recording head is of the permanent magnet type in the form of a cylinder 80 having appropriately spaced magnetic poles on the surface thereof, designated N and S in FIGS. 4 and 5. The spacing of the magnetic poles would be the same as the required line spacing on the magnetic tape 12, which has been found to be approximately three mils. In recording, magnetic tape 12 would be rolled over the cylindrical recording head 80 and in contact with it whereby a line recording is made. One advantage provided by cylindrical head 80 is that because no portion of tape 12 passes through an alternating magnetic field, as it does when passing over a convention magnetic recording head, the tendency to record and then erase what has just been recorded is eliminated. This, in turn, can provide improved resolution in the recording. An additional advantage provided by permanent magnet recording head 80 is the lack of complicated electronic circuitry and freedom of voltage regulation problems. On the other hand, after making of the first copy the head 80 must be physically removed from contact from tape 12. One method of fabricating head 80 would be to record the N-S poles on the outer surface of a cylinder of magnetically retentive material using a conventional electromagnetic recording head.

Figure 6:
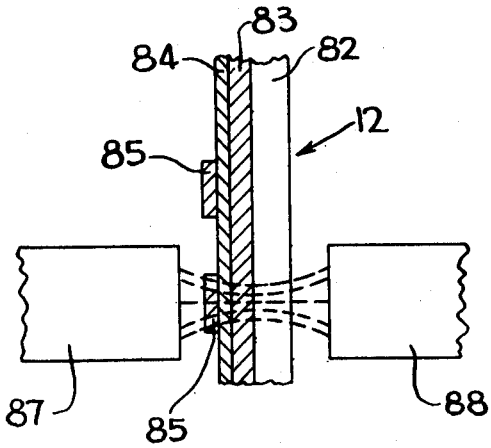
FIG. 6 is a diagrammatic view, partly in section, illustrating the operation of an alternative magnetizing arrangement which can be employed in the method and apparatus of FIG. 1.
Figure 7:
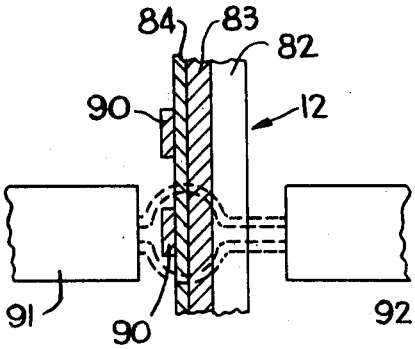
FIG. 7 is a diagrammatic view, partly in section, illustrating the operation of an alternative demagnetizing or magnetic erasing arrangement which can be employed in the method and apparatus of FIG. 1.

In the embodiment of FIG. 1 the magnetic image is formed on the recording means or tape 12 by first placing a continuous uniform magnetic recording on tape 12 by magnetizing the iron oxide which is on one face of the tape with the record head in contact with the opposite face of the tape. This was followed by selective erasure of the recording because of the shielding effect of the magnetic toner particles on tape 12 thereby providing the magnetic image. FIGS. 6 and 7 illustrate alternative techniques for forming a magnetic image on tape 12. FIG. 6 shows an arrangement whereby the magnetic recording is made selectively, that is a recording is made on tape 12 only under the toner particles. As a result, the step of selective erasing of the magnetic recording is eliminated. Tape 12 is shown in FIG. 6 as comprising a base or substrate layer 82 coated with an iron oxide layer 83 overlaid by a zinc oxide layer 84. Two toner particles are designated at 85 as they would appear adhered to tape 12 after it leaves the toner applying apparatus 25 in FIG. 1. Tape 12 is passed through the air gap between two magnetic pole pieces 87 and 88 which are energized or excited in a suitable and conventional manner. The magnetic toner particles such as that designated 85 serve to reduce the reluctance of the air gap and thereby increase the flux density and concentrate the magnetic flux to a point where a magnetic recording is provided on tape 12 under the toner particles. This is illustrated by the dashed lines in FIG. 6 which indicate magnetic flux lines. The higher the desired resolution in the magnetic recording the higher must be the gradient of the magnetic flux density. The advantage derived from this technique is that positioning of tape 12 relative to the pole pieces 87, 88 is not critical. In other words, tape 12 can vibrate or be off center relative to the magnetic pole pieces and not yield any undesired electrical modulation products in the recording.

FIG. 7 illustrates an alternative arrangement for selectively erasing the continuous magnetic recording placed on tape 12 as in the embodiment of FIG. 1. This arrangement would replace the apparatus including core 38, coil 30 and source 42. Tape 12 shown in FIG. 7 has the same composition as tape 12 in FIG. 6, namely substrate layer 82, iron oxide coating 83 and zinc oxide coating layer 84. The magnetic toner particles designated 90, however, in addition to having an electrostatically attractive and a magnetic component have an electrically conducting component. This can be accomplished, for example, by adding a silver dispersion to the magnetic toner material. Tape 12 is passed through the air gap between magnetic pole pieces 91, 92 which, in turn, are energized from a high frequency source, for example at a frequency of 10 megacycles. When a high frequency magnetic field is applied to a conductive material, eddy currents are induced in the material. The resulting magnetic field generated by the eddy currents opposes the applied field and the net result is that the total magnetic field is reduced and in some cases virtually eliminated in the conducting material. The behavior of the magnetic flux lines is shown by the dashed lines included in FIG. 7. The magnetic flux lines are in effect deflected around the magnetic toner particles 90. The result is that the continuous magnetic recording previously applied to tape 12 is selectively erased. The advantage provided by this technique, as in that of FIG. 6, is that the positioning of tape 12 between the pole pieces 91, 92 is not critical. In other words, tape 12 can vibrate or be off center relative to the magnetic pole pieces and not result in the production of unwanted modulation products in the recording on tape 12.

Figure 8:
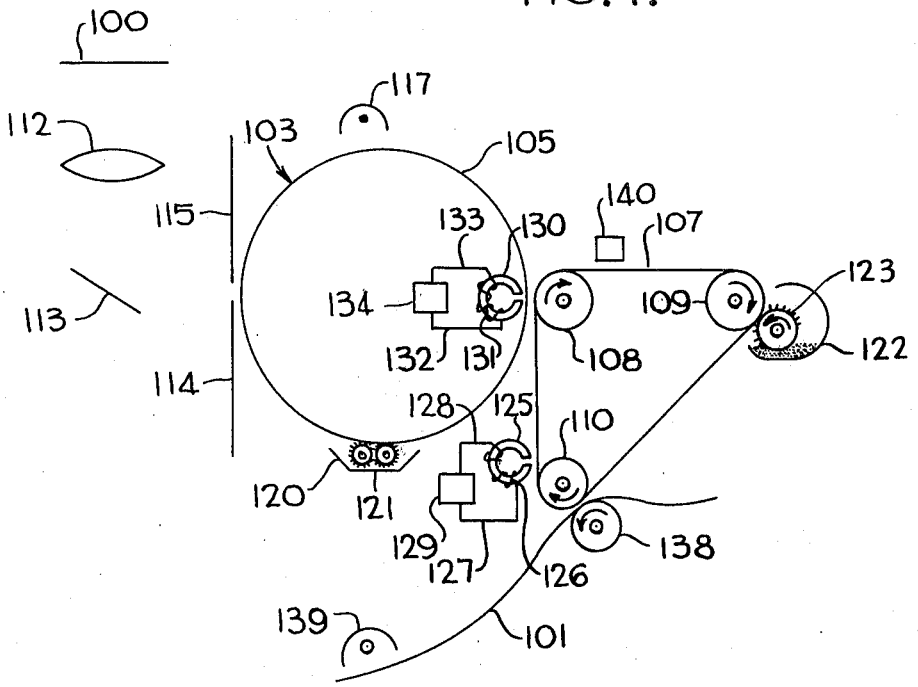
FIG. 8 is a diagrammatic view of a method and apparatus for transferring graphical information in photocopying according to a second embodiment of the present invention.

FIG. 8 illustrates apparatus according to a second embodiment of the present invention for transferring graphical information from an original medium, such as a document indicated generally at 100, to a copy medium such as ordinary paper designated 101. The apparatus comprises a recording means having a surface capable of supporting an electrostatic image and a surface which is magnetizable. In this embodiment, the recording means comprises a storage means in the form of a rotatable drum 103 having a surface, in particular the drum outer surface 105, capable of supporting electrostatic images. Drum 103 is drivenly connected to a suitable drive means (not shown) for rotating the same at a controlled speed. The recording means further comprises an orbitally movable magnetically retentive member in the form of tape 107 capable of surface magnetization. Tape 107 is endless and positioned around and supported by rollers 108, 109 and 110 which define an orbit for tape 107. In addition, rollers 108–110 and tape 107 are positioned relative to drum 103 so that tape 107 is in close proximity to surface 105 during a portion of the orbit of tape 107. Rollers 108–110 are drivenly connected to a suitable drive means (not shown) for rotating the same and hence for moving tape 107 at a controlled speed. Surface 105 of drum 103 can comprise a coating of zinc oxide or other material suitable for supporting electrostatic images as employed in standard electrostatic image photocopying techniques. Tape 107 can comprise any suitable magnetizable material such as any ordinary commercially available magnetic tape, and the width of tape 107, like the width of tape 12 in the embodiment of FIG. 1, is substantially equal to the width of the copy medium or paper 11.

The apparatus further comprises means for transforming an optical image of information on the original medium 100 to an electrostatic image on the recording means. Light rays from the original 100, which is illuminated, are directed through a lens 112 onto a tracking mirror 113 whereby they are further directed through a slit 114 in a shield member 115 onto the surface 105 of drum 103. The image scan performed by tracking mirror 113 is synchronized with the rotation of drum 103. Surface 105 of drum 103 is electrostatically charged by means of a charging unit indicated at 117. As light rays corresponding to the image of original 100 reach the charged surface 105 of drum 103, the high light level or intensity portions of the image discharge the zinc oxide and the low light level or intensity regions of the image cause the zinc oxide to remain charged. As a result, an electrostatic image corresponding to the optical image from original 100 is placed on the surface 105 of the drum. This procedure for forming the electrostatic image on drum 105 is similar to that of standard electrostatic photocopying procedures.

The apparatus further comprises means for applying magnetic toner particles to a surface of the recording means in a manner such that the particles adhere to the surface of the recording means in the form of an image corresponding to the image already present on the surface. Magnetic toner particles are applied to surface 105 of drum 103 by an arrangement including a storage receptacle such as a trough 120, the open end of which is positioned near drum 103, and including a plurality of toner applying brushes 121 in trough 120. This arrangement is merely illustrative of other suitable arrangements which can be utilized for applying magnetic toner particles to the surface of drum 103. When applied, the toner particles are attracted to surface 105 by the electrostatic charge thereon and in correspondence with the electrostatic image. Magnetic toner particles also are applied to a surface of tape 107, in a manner which will be described presently, by means of an arrangement including a storage receptacle or trough 122 the open end of which is positioned near tape 107 which trough houses a toner applying brush 123. Likewise, this arrangement is merely illustrative of others which can be employed for applying toner particles to tape 107.

The apparatus according to this embodiment of the present invention further comprises magnetic image forming means operatively associated with the recording means for magnetizing portions of the recording means as determined by the location of the toner particles thereon to form a magnetic image corresponding to the electrostatic image. According to this embodiment of the present invention the magnetic image forming means comprises magnetizing means positioned relative to tape 107 to operate thereon prior to passage of tape 107 into proximity with the storage means or drum 103. The magnetizing means in preferred form includes a core 125 around which is wound a coil 126 which is connected by leads 127, 128 to a source 129 of magnetizing current. The current or signal supplied by source 129 preferably is periodic, such as sinusodial or pulsed, having a wave length of about three mils. This wavelength was found to produce a recording of satisfactory resolution. Thus when core 125 is energized a continuous magnetic recording is placed on tape 107. The magnetic image forming means further comprises demagnetizing means or magnetic erasing means positioned to operate on tape 107 after operation thereon by the magnetizing means. Referring to FIG. 8, the demagnetizing means comprises a core 130 around which is wound a coil 131 which is connected by means of leads 132, 133 to a source 134 of demagnetizing or erasing current. In this particular illustration core 130 is located within drum 103 and located relative to the circumference thereof at the point where tape 107 is brought into close proximity with the drum surface 105. As a result core 130 when energized applies a demagnetizing or erase current in a direction toward the toner particles adhered to the surface of drum 103 and toward tape 107. The toner particles, in turn, provide a magnetic shunt thereby resulting in selective erasing of the continuous recording on tape 107 to form a magnetic image corresponding to the electrostatic image.

The apparatus according to this embodiment of the present invention finally includes transfer means for transferring the toner particles from the recording means to the copy medium, such as paper 101, whereby a copy of the original 100 is made and the magnetic image remains on the recording means for the production of additional copies. A roller 138 drivenly connected to a suitable drive means (not shown) is located in operative association with roller 110 whereby as a copy medium or paper 101 passes between the rollers 110, 138 the magnetic toner particles from tape 107 are frictionally transferred to the paper 101. A standard fusing or fixing apparatus such as a lamp 139 is included for fixing the powder particles to the paper 101 in a conventional manner.

The apparatus of FIG. 8 is operated in the following manner to carry out the method of the present invention. An electrostatic image of input graphical information from original 100 is formed on a surface of the recording means. Tracking mirror 113 and lens 112 form an image on the zinc oxide coating 105 of drum 103, and the image scan by mirror 113 is synchronized with the rotation of drum 103. As previously described a standard charging operation is performed on the drum by the charging apparatus 117. As the drum 103 rotates further past the toner applying apparatus 120, 121, magnetic toner particles are applied to drum surface 105 in a manner such that the particles adhere to the surface in correspondence with the electrostatic image. The magnetic toner particles are the same as those employed in the apparatus of FIG. 1 having both an electrostatically attractive component, a magnetic component, and a resinous component.

Next, portions of a surface of the recording means are magnetized to form a magnetic image corresponding to the electrostatic image. A continuous magnetic recording is applied to tape 107 by core 125 and coil 126 energized from source 129. The recording is made by a periodic signal having a wave length of about three mils as previously described. As tape 107 is passed in proximity to drum surface 105, this recording is erased to conform to the electrostatic image on drum surface 105. In particular an erase signal produced when core 130 and coil 131 are energized from source 134 is passed through drum surface 105 toward tape 107, and the magnetic toner particles forming the image provide a magnetic shunt for this signal. In those regions corresponding to dark areas of the original optical image, the magnetic toner particles provide a magnetic toner particles provide a magnetic shunt for the erase magnetic field. As a result the recording on the tape 107 will not be erased. In those regions corresponding to light areas from the original optical image the erase magnetic field will penetrate to the magnetic tape 107, due to the absence of toner particles, and erase the pre-recorded signal. At this point the magnetic toner particles leave drum suface 105 and are transferred to the magnetic tape 107, they are held thereto by the magnetic attraction of those portions of the magnetic recording which have not been erased. This magnetic attraction is of sufficient strength to overcome the electrostatic attraction of the charged portions of drum surface 105. Tape 107 travels further through its orbit toward the toner dispenser apparatus 122, 123 whereupon additional magnetic toner particles are applied to tape 107 forming a powder image in correspondence with the magnetic image. As a result there is present on the surface of tape 107 a positive toner particle image copy held to magnetic tape 107 by the magnetic attraction of the recorded magnetic image thereon.

The next step in the method of the present invention is transferring the toner particles from the recording means, here tape 107, while leaving the magnetic image thereon. As tape 107 is passed between rollers 110, 138 the toner particles are transferred by friction to the paper 101. This frictional transfer process is believed to be enhanced by the inherent porosity of the paper. Paper 101 then is passed near the fusing apparatus 139 whereby the toner particles are permanently fused or fixed to the paper. Tape 107 with the magnetic image thereon can be passed through successive orbits, gathering toner particles from the apparatus 122, 123 each time, to make additional copies. During the successive cycles the recording and erase heads 125 and 130, respectively, are not energized and no electrostatic image is required to be formed on drum 103. Thus as in the embodiment of FIG. 1, one significant advantage is that successive copies can be generated at a higher speed than the first copy because there is no need to further scan the original 100. In addition the original can be removed from the apparatus during production of the additional copies. Both advantages arise from the fact that the image formed therein is not volatile. Also as in the embodiment of FIG. 1, the apparatus operates satisfactorily with ordinary bond paper.

The apparatus would include, in addition, a suitable control system for deactivating the magnetizing means 125, 130, scanning means, charging unit 117, and drive means for drum 103 during production of additional copies as well as for operating these components during production of the first copy. In addition there would be provided controlled means for feeding copy media or paper sheets through the apparatus successively as in conventional photocopying apparatus. A magnetic erasing element 140 similar to the arrangement of FIG. 1 including core 50 is included for removing the magnetic image from tape 107 prior to the introduction of a new original 100 to the apparatus for the start of a new copying operation. Cores 125 and 130 each have a length sufficient to extend across the width of tape 107.

Figure 9:
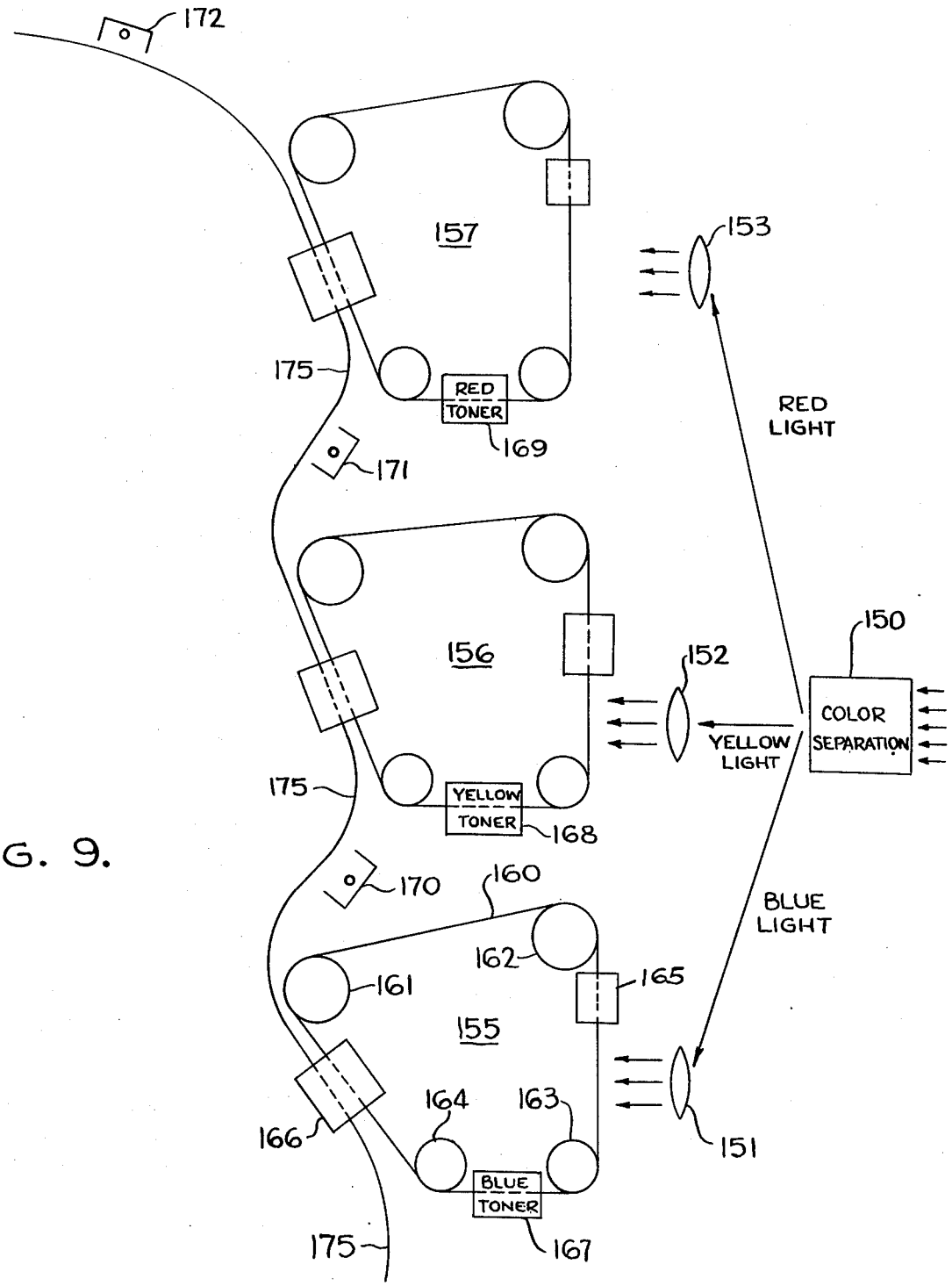
FIG. 9 is a diagrammatic view illustrating a manner in which the method and apparatus of FIG. 1 is readily adaptable to colored photocopying.

FIG. 9 illustrates an arrangement whereby the method and apparatus shown in FIG. 1 is readily adaptable to colored photocopying. To the means illustrated in FIG. 1 for transforming an optical image into an electrostatic image there is added a means indicated generally at 150 for separating the optical image from the original medium into a plurality of color components thereof. In this particular illustration the means 150, which can comprise a prism and/or filter system, separates the input light image into the three colors red, yellow and blue. Each of the color components, in turn, is directed by one of the lenses designated 151–153 for the formation of a corresponding electrostatic image. The apparatus includes a plurality of combinations of elements, in this particular example three, one combination for each color component and each combination being similar to the arrangement shown in FIG. 1. In particular, combination 155 includes an endless tape 160 movable through an orbit, as defined by rollers 161–164, which tape 160 is identical in construction to tape 12 of FIG. 1. Combination 155 further includes charging apparatus 165 similar to apparatus 21 in FIG. 1 and means, designated generally at 166, for forming a magnetic image on tape 160 in a manner similar to the arrangement of recording head 30 and erase head 38 shown in FIG. 1.

The combination 155 thus includes elements similar to those present in the apparatus of FIG. 1 and operates in a similar manner. It also includes toner applying means, here indicated at 167, for applying toner particles in a manner similar to the operation of toner applying means 25 in FIG. 1. In this particular embodiment, however, the means 167 applies colored toner particles, here blue, of a color corresponding to that of the light directed by lens 151 on tape 160. In a similar manner combinations 156 and 157, which include arrangements of elements identical to that of combination 155, include toner applying means 168 and 169, respectively, for applying colored toner particles, i.e. yellow and red, respectively, of a colored corresponding to the light rays directed on the tape from lenses 152 and 153, respectively. Thus, the apparatus of FIG. 9 includes a number of combinations equal to the number of color components separated from the image, which can be more or less than the three illustrated in FIG. 9. The copy medium indicated at 175, such as ordinary bond paper, passes sequentially by the three combinations 155–157 and on each passage has transferred thereto colored toner particles corresponding to a particular colored portion of the image. After each passage those toner particles are fused or fixed to the paper by the fusing units indicated at 170–172. The magnetic images retained on the tapes in the combinations 155–157 can be utilized for the formation of additional copies by means of an identical procedure.

Figure 10:
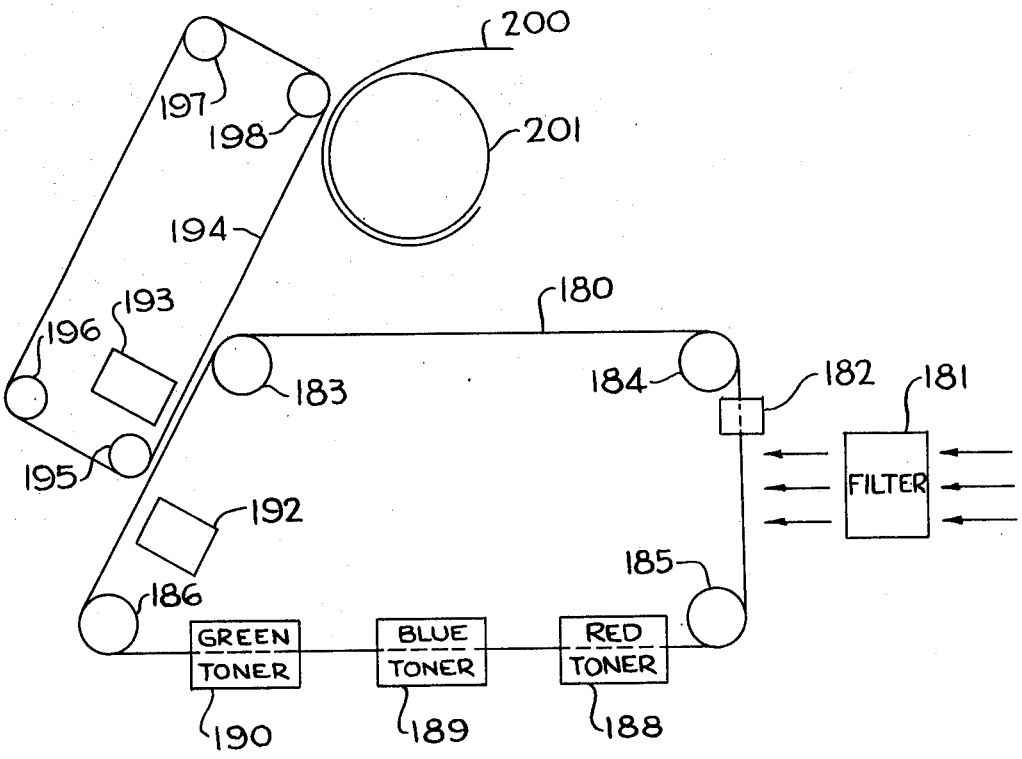
FIG. 10 illustrates an alternative arrangement thereof for colored photocopying.

FIG. 10 illustrates an alternative arrangement for making color reproductions with the apparatus of the present invention. A recording means 180 is identical in form to tape 12 but increased in length relative thereto to hold two or more, in this particular example three, monochromatic images of the original. A monochromatic filter 181 is employed and placed in the image path of the light from the original to allow only one narrow band of visible light to reach tape 180 for formation of an electrostatic image after tape 180 has been charged by a standard unit 182. In a tri-color system as illustrated in FIG. 10, sequential red, blue and green sets of images are presented along the lengths of tape 180. Tape 180 then travels through an orbit defined by driven rollers 183–186 and passes serially or sequentially through three separate means for applying different colored magnetic toner particles, designated 188–190 in FIG. 10. In a manner similar to the operation of the apparatus of FIG. 1, powder images are prepared for printing by the introduction of colored magnetic toner particles placed in contact with the electrostatic image that represents the proper chromatic information. Thus, in this particular example, red, blue and green toner will be introduced to the red, blue and green electrostatic images in a manner such that only red toner can be picked up by the red electrostatic image, etc. This may be performed by including a solenoid-operated roller arrangement in each of the means 188–190 to insure that the proper chromatic image is placed in contact with the correct color toner in a sequential fashion.

Tape 180 then has three chromatic images bearing toner particles of the proper color on each image. The tape 180 next is provided with a continuous magnetic recording by means indicated generally at 192 which can be identical to recording head 30 and associated components illustrated in FIG. 1. The recording then is selectively erased by means indicated generally at 193 in a manner similar to the operation of erase head 38 and associated components in FIG. 1. Prior to passage of tape 180 is proximity with the erasing means 193 there is introduced a transfer belt 194 which moves through an orbit defined by rollers 195, 196, 197 and 198. As selective erasing is performed by means 193, the toner particles are removed from tape 180 and picked up by transfer belt 194 in a manner similar to offset printing techniques. Belt 194 then is brough into proper registration with the copy medium such as bond paper indicated at 200. Paper 200 must be traveled through a number of rotations equal to the number of color images, in this particular illustration three, which can be done by means such as a drum 201. The operation is such as bring the paper 200 into printing contact with the three separate chromatic toner images on transfer belt 194 in a sequential fashion. The toner particles are caused to leave belt 194 and adhere to paper 200 by a frictional transfer process occurring in the region of contact between drum 201 and roller 198. While not absolutely necessary for this apparatus, belt 194 prevents smearing or smudging of the copy on paper 200 which can be caused by residual toner particles on tape 180 if paper 200 were to contact tape 180 directly for the repeated number of times required for colored copying. Transfer belt 134 should be of a material having an affinity for the magnetic toner particles greater than the affinity of magnetic tape 180. After the multicolor separation images are transferred to paper 200, it is released from drun 201 whereupon the toner particles are fused to the paper and the completed copy is released from the apparatus. The magnetic image which is retained on tape 180 can be utilized for the formation of additional copies by means of an identical procedure.

Figure 11:
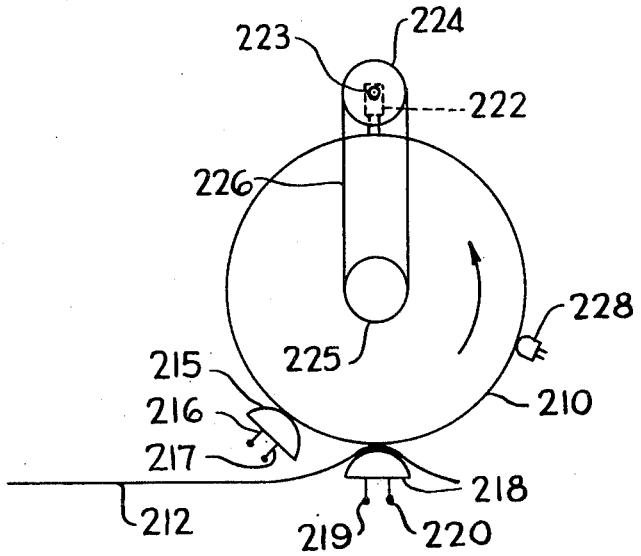
FIG. 11 is an end elevational view of apparatus according to the present invention for transferring graphical information to and from computer apparatus.
Figure 12:
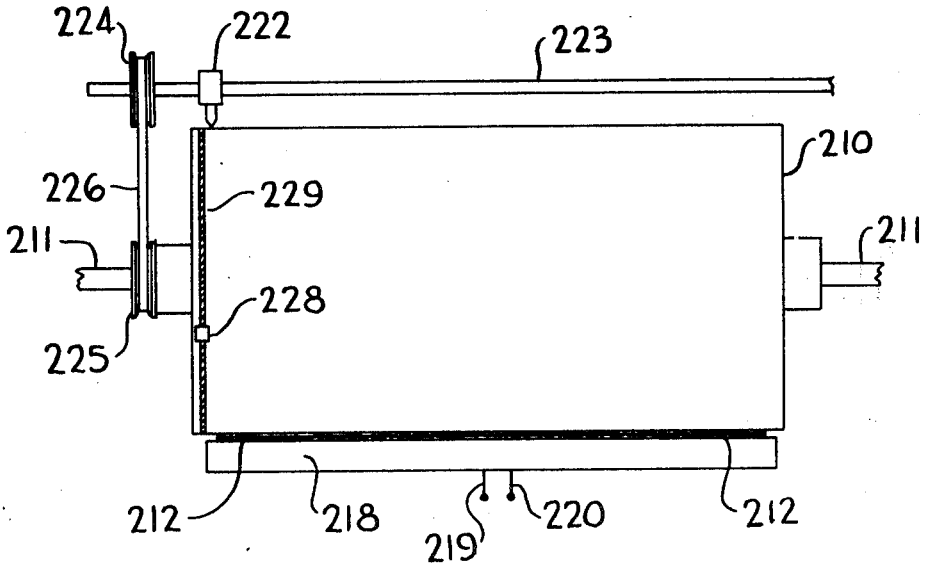
FIG. 12 is a side elevational view of the apparatus of FIG. 11.

FIGS. 11 and 12 illustrate a method and apparatus according to the present invention for transferring graphical information to and from a computer for storage and/or processing. The apparatus comprises a magnetic storage means such as drum 210, the outer surface of which is capable of being magnetized. Drum 210 is mounted on a drive shaft 211 which, in turn, is drivenly coupled to a suitable drive means (not shown) for rotating drum 210 about its axis. In the present instance the apparatus is illustrated in connection with the transfer of information from a graphical input medium to a computer but it should be understood that the apparatus can be utilized to reversably transfer such information. A hard copy input designated 212 comprises magnetic material in the form of magnetic toner particles fixed on a surface such as that of ordinary bond paper, the particles being arranged or positioned according to the graphical information. It should be noted that hard copy 212 is available as the product of the photocopying method and apparatus of the present invention.

The apparatus further comprises means for magnetizing the surface of drum 210 in a manner forming a magnetic image of the graphical information on the input medium or hard copy 212. In preferred form the magnetizing means comprises a magnetic recording head indicated at 215 in FIGS. 11 and 12 adapted for connection as by leads 216 and 217 to a source of magnetizing current. Recording head 215 is operated in a manner to apply a continuous magnetic recording to the surface of drum 210 which presently will be described. The magnetizing means also comprises a magnetic erase head designated 218 in FIGS. 11 and 12 adapted for connection as by leads 219, 220 to a source of demagnetizing or erase current. Erase head 218 is operated and input medium 212 is passed between it and the surface of drum 210 in a manner so as to selectively erase the recording to form a magnetic image on drum 210 corresponding to the graphical information on medium 212 in a manner presently to be described. Heads 215 and 218 have the same length which, as shown in FIG. 12, is approximately equal to the length of drum 210.

The apparatus according to this embodiment of the invention further comprises scanning means in the form of a magnetic playback head designated 223 and circuitry associated therewith for scanning the magnetic image on drum 210 and generating a sequential signal indicative of the input graphical information. Magnetic playback head 222 is connected on a lead screw 223 which, in turn, is drivenly coupled to the drum drive shaft 211 by means of a pulley 224 connected on screw 222, a pulley 225 connected on drive shaft 211, and a drive belt 226 engaging pulleys 224 and 225. The apparatus further comprises means in the form of a recording head 228 for recording a synchronization signal on the surface of drum 210, in particular along a track 229, simultaneous with formation of the magnetic image on the surface of drum 210.

To perform the method according to this embodiment of the present invention, the apparatus shown in FIGS. 11 and 12 is operated in the following manner. The method or procedure is reversible and in one direction is characterized by transfer of the graphical information to magnetic information followed by scanning of this information for sequential signal presentation to computer apparatus for further processing, storage or both. The information generated in response to scanning is in the form of a varying amplitude constant frequency electrical signal. Referring now to FIGS. 11 and 12, input medium 212 is taken and moved into proximity with the surface of drum 210. The input medium is in the form of toner particles fused or otherwise fixed to bond paper or electrofax paper other suitable substrate material having a thickness of approximately three mils. The surface of drum 210 is magnetized in a manner to form a magnetic image of the graphical information on input medium 212. This is performed in two steps by first energizing recording head 215 with a periodic signal of an appropriate frequency such as 1000 cycles to place a continuous recording on the surface of drum 210 as it passes by the recording head 215. Input medium 212 is passed between erase head 218 and the surface of drum 210. A demagnetizing or erase current is applied from head 218 in a direction toward the toner particles on input medium 212 and toward the surface of drum 210 whereby the toner particles provide a magnetic shunt thereby providing a selective erasing of the recording to form a magnetic image thereon. In the regions of the input medium 212 that contain magnetic toner particles (gray-black information) the erase field is shunted in proportion to the density of toner particles and the erasure of the recorded signal is in proportion to the magnitude of the erase field reaching the magnetic medium on the drum 210. In other words, corresponding to the black area of hard copy 212 the erase field does not cause any erasure of the prerecorded signal on drum 210 while corresponding to the white areas of copy 212 complete erasure of the signal on drum 210 takes place. Upon complete passage of the input medium 212 or hard copy past the erase head 218, the record and erase heads 215 and 218 are deenergized thereby preventing any further change in the magnetic information stored on drum 210.

Simultaneous with the step of forming a magnetic image, there is performed a step of recording a synchronization signal on the surface of drum 210. In particular, in response to the introduction of input medium 212 to the apparatus a sensor is activated to place in operation the record head 228 whereby a synchronization track 229 is recorded in registration with the graphical magnetic image on drum 210. When the input medium 212 leaves the apparatus, head 228 is switched electrically from a record mode to a playback mode of operation. In the latter mode the head 228 provides vertical scanning position information to the computer in an appropriate code.

The next step according to the method of the present invention is scanning of the magnetic image on drun 210 to generate a sequential signal indicative of the graphical information. The magnetic head 222 has associated therewith appropriate circuitry whereby its output signal is interfaced properly with the computer input equipment in terms of signal level and format. Drum 210 then is rotated at a higher velocity such that the rate of scanning is matched with the computer input or storage data rates. As drum 210 rotates, the scanning means 222 is moved relative to drum 210 and in a first direction and simulaneously in a second orthogonal direction whereby a raster type signal is generated during scanning. In particular, as drum 210 rotates, lead screw 223 moves head 222 in a direction along the axis of drum 210 to dissect the magnetic image into a sequential raster type electrical signal until the complete magnetic image is scanned. The magnetic image stored on drum 210 may be retained and reused as many times as desired. The introduction of a new input medium or hard copy, however, will cause erasure of the last stored image as the new recording is made.

A lateral coordinate signal may be generated by a digital count of a revolution count derived from the output of head 228. The various parameters determining the resolution of the system may be selected to provide several mils of resolution in both horizontal and vertical directions. A reduction in the horizontal resolution would be provided by changing the pulley ratios between drum 210 and lead screw 223.

The method and apparatus according to this embodiment of the present invention provides an optical to computer interface with a relatively simple and inexpensive arrangement. An optical image of graphical information is transferred into the form of hard copy 212, comprising magnetic toner particles on a substrate, by the method and apparatus of the embodiment of FIG. 1 or, alternatively, of FIG. 8. The need to employ expensive electro-optic scanning devices is thus obviated. Other advantages are derived from the fact that additional copies may be produced in the same or in a distant locale at the same or at a later time. Copies may be transmitted merely for reproduction in the same form or they can be processed in modified form such as enlarged or combined. In addition, once the graphical information is in the computer it is not necessary that the same means of image reproduction be used at the time of withdrawal.

The interrelationship between the method and apparatus of FIGS. 11 and 12 and that of FIGS. 1 and 8 thus is readily apparent. Graphical information in the form of an optical image is transformed by the apparatus of FIG. 1 or FIG. 8 into the form of magnetic toner particles fixed to a substrate such as paper. This, in turn, provides the hard copy input for the apparatus of FIGS. 11 and 12 to provide a sequential signal indicative of the graphical information which is usable by computer apparatus for storage or processing or both. It is within the scope of this invention to reverse the foregoing procedure whereby information stored in the computer can be transferred to graphical in the form of a conventional hard copy. Thus a line-by-line magnetic recording can be made on a tae or drum according to a sequential signal derived from the computer. To the magnetic image thus formed on the tape or drum can be applied magnetic toner particles which subsequently are transferred to a paper by friction and then fixed thereto. It should be noted also that the hard copy input 212, comprising magnetic toner particles fixed to a substrate such as paper, utilized in the method and apparatus of FIGS. 11 and 12, can be substituted for drum 103 and associated optical scanning apparatus shown in FIG. 8, whereby a magnetic image is formed on tape 107 directly from the hard copy thereby eliminating the need to form an electrostatic image.

A method and apparatus according to another embodiment of the present invention for transferring graphical information is illustrated in FIGS. 15–19. An optical image of the graphical information from an original medium 250 is transformed to an electrostatic image on an input medium 252, having a surface capable of supporting an electrostatic image, by a lens 254 which directs light rays from medium 250, which may be illuminated, onto the surface of medium 252 and by an electrostatic charging unit 256 which operates on medium 252 prior to its reception of light rays from the medium 250. Medium 252 preferably comprises conventional zinc oxide coated paper which is commonly used in electrostatic printing and copying processes and having a thickness of about 0.003 to 0.0035 inch. Paper 252 is stored in and fed by a suitable means designated generally at 258 in FIG. 15. Charging apparatus 256 is similar in form and operation to apparatus 21 of the embodiment of FIG. 1 and for this reason any further description is deemed to be unnecessary. Also in a manner similar to that of the embodiments of FIGS. 1 and 8, when more than one copy is to be made, charging apparatus 256 operates only during production of the first copy as will be described in detail hereafter.

The electrostatically charged paper 252 is moved past the image of light rays directed through lens 254 from the original 250 and in synchronism wih the scan of the original 250. When the light rays reach the outer surface of paper 252 the high light level portions of the image discharge the zinc oxide while the portions of the paper contacted by the low light level portion of the image remain charged. An electrostatic image thus is formed on paper 252 and this image formation likewise is required only during production of the first of a number of duplicate copies as will be described hereafter.

Figure 15:
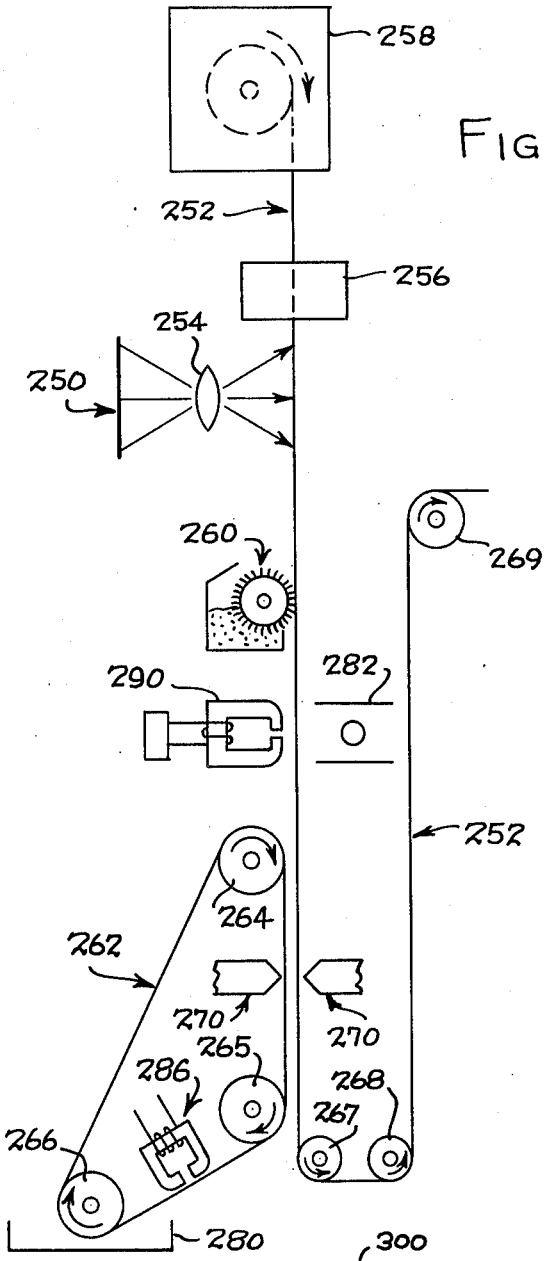
FIG. 15 is a diagrammatic view of a method and apparatus for transferring graphical information according to another embodiment of the present invention.

The apparatus of the present invention further comprises means, designated generally at 260 in FIG. 15, for applying magnetic toner particles to input medium or paper 252 in a manner such that the toner particles adhere to input medium or paper 252 in the form of an image corresponding to the image already present thereon, i.e. to the electrostatic image. The toner particles preferably are elongated, and the means 260 for applying the same can comprise an arrangement of trough and brush similar in construction and operation to that shown at 120, 121 in FIG. 8.

The apparatus according to this embodiment of the present invention further comprises a recording or storage means 262 having a surface capable of being magnetized. Means 262 comprises an orbitally movable, magnetically retentive member capable of surface magnetization and in the form of an endless tape. Tape 262 preferably comprises a base or substrate of suitable material, such as Mylar, having a thickness of about 0.001 to 0.002 inch, and a coating of magnetic material, such as gamma ferrie oxide having a thickness of about 0.001 inch. The width of tape 262 is determined by the width of the copy being made. Tape 262 is trained around three supporting rollers 264, 265 and 266 which define an orbit for tape 262. Rollers 264–266 together with suitable drive means (not shown) to which they are coupled comprise part of the motive means for the apparatus of FIG. 15. The motive means of the apparatus further comprises rollers 268 and 269 coupled to suitable drive means (not shown) around which input medium or paper 252 is trained for movement through the apparatus. The motive means operates to cause relative displacement between input medium 252 and storage means 262 and for positioning input medium 252 into proximity with storage means 262 during a portion of the displacement thereof.

The apparatus according to this embodiment of the present invention further comprises magnetic image forming means, designated generally at 270 in FIG. 15, for magnetizing the surface of storage means 262 in accordance with the image on input medium 252. Means 270 operates, briefly, to establish a magnetic field whereby passage of magnetic flux to tape 262 is facilitated by the pattern or image of magnetic toner particles on medium 252 so as to magnetize tape 262 in areas corresponding to those areas where toner particles are present on the medium 252. In the present illustration, magnetic image forming means 270 comprises two relatively sharp magnetic pole pieces energized by suitable means (not shown) and positioned so that magnetic flux travels between the pole pieces in a direction generally perpendicular to the plane of tape 262. Tape 262 and paper 252 travel through the gap between the pole pieces. The gap preferably is relatively small, sufficient in length to allow passage therethrough of tape 262 and paper 252, and can be calculated from the foregoing information given for paper and tape thicknesses and using a thickness of 0.0005 to 0.001 for the toner.

The apparatus according to this embodiment of the present invention further comprises means, designated generally at 280, for applying magnetic toner particles to storage means or tape 262 in a manner such that the particles adhere to tape 262 in the form of an image corresponding to the magnetic image thereon. Toner applying means 280 can be similar in construction and operation to means 25 shown in FIG. 1. The toner particles applied by means 280 are carried by tape 262 along the orbit thereof for transfer to paper 252 in a manner which will be described in detail hereafter. The magnetic toner particles also have a resinous component to facilitate subsequent fixing, and can be of various commercial forms such as Tribofax 213. By virtue of this arrangement, a copy of the original is made and the magnetic image remains on the storage means or tape 262 for the production of additional copies in a manner similar to that of the embodiments of FIGS. 1 and 8.

After paper 252 has received the transferred toner particles it is caused to travel to a conventional fusing unit indicated generally at 282 in FIG. 15 for fixing the toner particles to paper 252. Unit 282 is similar in construction and operation to unit 28 of the embodiment of FIG. 1 so that a further description is deemed to be unnecessary. In addition, unit 282 is located in the apparatus of FIG. 15 so as to fix also the toner particles applied by means 260 to input medium 252 prior to positioning thereof in proximity to the storage means 262.

The apparatus of this embodiment of the present invention is provided with a magnetic erasing or demagnetizing meand, designated generally at 286, which operates on magnetic tape 262 when the magnetic image or recording thereon is no longer needed, such as when only one copy is wanted or after a desired number of copies has been produced. In addition, there can be provided suitable means (not shown) for removing residual toner particles as in the embodiment of FIG. 1. The apparatus further comprises magnetic means 290 for causing the magnetic toner particles applied by means 260 to input medium 252 to be preferentially oriented in a given direction with respect to the surface of medium 252 when the particles are fixed to paper 252 by the unit 282. The apparatus also would include a suitable control system for deactivating the charging means 256 and scanning means, toner applying means 260, magnetizing means 270 and 290, and magnetic erasing means 286 during production of additional copies, as well as for operating these components during production of the first copy.

To perform the method according to this embodiment of the present invention the apparatus shown in FIG. 15 operates in the following manner. There is formed an electrostatic image of input graphical information from the original medium 250, such as a document, on the surface of input medium 252, which preferably is zinc oxide coated paper. The formation of the electrostatic image is performed in a manner similar to the method of the embodiment of FIG. 1 so that an additional description is deemed to be unnecessary. Then magnetic toner particles are applied by means 260 to the surface of input medium 252 in a manner such that the particles adhere to the surface in correspondence with the electrostatic image. The particles employed are elongated in shape and consists of a magnetic material of high permeability. In particular, the elongated toner particles applied by means 260 have a magnetic component, an electrostatically attractive component, and a resinous component. Various commercially available forms of toner particles can be employed and, alternatively, needle-shaped particles of soft iron provided with a resinous coating can be used. The particles are then fused to the input medium or zinc oxide coated paper 252 by heater unit 282 and while under the influence of magnetic means 290. The applied magnetic field causes the elongated particles to be preferentially oriented in a given direction with respect to the surface of paper 252, such as in a direction perpendicular to the plane of paper 252.

Input medium or paper 252 having magnetic material positioned on a surface thereof in accordance with the graphical information from original medium 250 is moved into proximity with the magnetic storage means 262 having a surface capable of being magnetized. The next step according to this embodiment of the present invention is magnetizing a surface of storage means 262 in a manner forming a magnetic image of the graphical information. This step of magnetizing is performed by applying a d.c. or a low frequency, i.e. about 500 c.p.s., a.c. magnetic field to input medium 252 and tape 262 as they are passed by the pole pieces of magnetic image forming means 270. Alternatively, the pole pieces of means 270 can be constructed to frame two large flat magnetic surfaces, and paper 252 and tape 262 while in contact are held stationary between the pole pieces and means 270 is energized for a fraction of a second. In either case, storage means or tape 262 has present thereon a magnetic image corresponding to the graphical information from input medium 252.

The magnetic image on storage means 262 then is utilized to transfer the graphical information to another medium. In the present illustration the other medium is the next portion of the paper 252. It is to be noted, however, that this method can be employed to transfer the graphical information to other types of mediums, for example to separate copy mediums or papers or to a suitable transducer whereby the magnetic image representative of graphical information can be transformed into electrical signals for transmission by suitable techniques to other apparatus.

The magnetic image or pattern formed on storage means or tape 262 in the present illustration is passed through means 280 which applies magnetic toner particles to the image. In other words, magnetic toner particles are picked up by the tape 262 in accordance with the magnetic pattern or image thereon. Tape 262 then moves further through its orbit to bring the toned region thereof into contact with paper 252 and on a portion of paper 252 displaced from the inked image previously fused thereon. When the magnetic toner particles on tape 262 come into contact with paper 252 they are mechanically transferred to the paper. The transfer of magnetic toner particles from tape 262 to paper 252 is a frictional transfer as in the embodiments of FIGS. 1 and 8 and is enhance by a firm contact between the two mediums. Storage means or tape 262 then can be recycled through means 280 for a number of times corresponding to the desired number of copies. Paper 252 which has been inked by the magnetic toner particles from tape 262 is passed by the fusing unit 282 whereupon the machine delivers second and third copies, etc., up to the desired number. After the desired number of copies is produced, magnetic erase means 286 is operated to remove the magnetic image from tape 262 thereby preparing the tape for receiving a new image.

Several additional factors have been determined to have significance in the method of this embodiment of the present invention. Transfer of the image from input medium 252 to storage means or magnetic tape 262 can be accomplished by application of either an a.c. or d.c. magnetic field, but the background appears to be clearer and hence the image contrast appears to be better when a d.c. field is used. There appears to be an optimum strength d.c. magnetic field for achieving good image transfer. For a very weak or very strong applied field the image contrast can be poor, but at some intermediate field strength, for example between about 50 gauss and about 500 gauss, the image contrast was observed to be good. Immediate contact between the image on input medium 252 and the magnetic recording surface of tape 262 is important for achieving good image transfer and good resolution.

Image transfer from input medium 252 to the magnetic tape or storage means 262 was observed to be better for patterns on medium 252 which are lightly inked as opposed to those which are heavily inked with magnetic material. If the pattern on input medium 252 is heavily inked so as to comprise a continuous layer of thin magnetic material, only the outline of the pattern or image is transferred to tape 262. As a result, the center region of the image transferred to tape 262 will not retain toner particles after passage through means 280. Heavily inked patterns on input medium 252 tend to behave in this manner. Toner retention is heavy near the pattern outline but is rather sparse inside each pattern or letter. Finely inked patterns on input medium 252 do not give rise to this effect and magnetic toner particle retention on tape 262 has been observed to be considerably better.

When the patterns or images on input medium 252 are sparsely inked with relatively large size magnetic toner particles, the image transfer from medium 252 to storage means or tape 262 has been observed to be in a one-to-one correspondence on a per particle basis. A preferred size for magnetic toner particles applied by means 260 to input medium 252 is about 100 mesh or 150 microns in diameter. Toner particles collect around each well-separated magnetic image on tape 262 over a diameter of about five times the diameter of each individual particle on medium 252. In regions of magnetic tape 262 corresponding to closely spaced particles on input medium 252, the toner particles again collect around each magnetic image but the diameter of the toner covered image was observed to be somewhat smaller. In either case, reproduced images on storage means or tape 262 of large individual particles on input medium 252 have been observed to be quite dense, exhibiting good contrast against a white background. Small magnetic toner particles on input medium 252 have been observed to give images on tape 262 which are relatively less effective in retaining magnetic toner particles.

The method and apparatus of this embodiment of the present invention has the same advantages as those of the embodiments of FIGS. 1 and 8, such as removal of the original from the apparatus during production of additional copies and generation of successive copies at a speed higher than that of the first copy, and provides a relatively high degree of resolution in the copies produced thereby.

Figure 16:
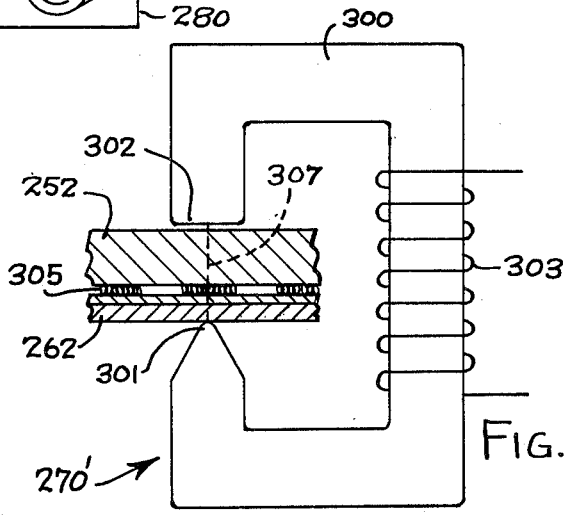
FIG. 16 is a diagrammatic view, partly in section, of an alternative construction of a portion of the apparatus of FIG. 15.

FIGS. 16–19 show in further detail alternative arrangements for the magnetic image forming means 270 of FIG. 15. Referring first to FIG. 16, magnetic image forming means 270′ comprises a magnetic core 300 having one relatively sharp pole piece 301 and a relatively flat faced pole piece 302, and there is wound around core 300 a coil 303 which is connected to a suitable source of energizing current (not shown). Paper 252 and tape 262 are shown in fragmentary form as they are positioned in close contact with each other in between pole pieces 301 and 302. The magnetic toner particles designated 305 form a pattern or image of the graphical information, and in this arrangement are disposed or oriented so that the longitudinal axes thereof are perpendicular to the planes of tape 262 and paper 252. For purposes of illustration, a single line of magnetic flux traveling between pole pieces 301 and 302 is shown by the broken line 307. Flux line 307 is directed along the axis of a toner particle 305 in the direction shown in FIG. 18 to cause magnetization of tape 262.

Figure 18:
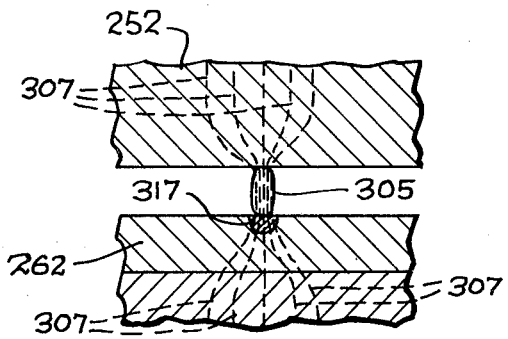
FIG. 18 is a diagrammatic view, partly in section, illustrating the operation of the construction of FIG. 16.

The effect of a single toner particle 305 on a plurality of flux lines 307 is shown in more detail in the enlarged view of FIG. 18. Flux is concentrated or funneled along elongated particle 305 to produce a relatively sharp, concentrated region of magnetization 317 in the surface of tape 262 adjacent one end of particle 305.

Figure 17:
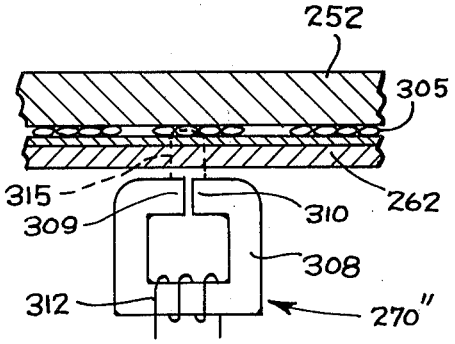
FIG. 17 is a diagrammatic view, partly in section, of an alternative construction of a portion of the apparatus of FIG. 15.

FIG. 17 shows a magnetic image forming means 270″ which can be employed in the apparatus of FIG. 15 when the magnetic toner particles are not oriented as previously described. In particular, magnetic toner particles 305 are disposed so that the axes thereof are generally parallel to the planes of tape 252 and 262. Means 270″ comprises a magnetic core 308 having two relatively flat-faced pole pieces 309, 310 defining a relatively narrow gap therebetween. A coil 312 is wound around core 308 and connected to a suitable source of energizing current (not shown). Paper 252 and tape 262 being in close contact with each other are positioned near means 270″ in a manner such that the gap between pole pieces 309, 310 is in proximity to the side of tape 262 which is opposite the side thereof contacted by the magnetic toner particles 305. For purposes of illustration, a single line of magnetic flux is indicated by the broken line 315 in FIG. 17. Magnetic flux 315 travels from one of the pole pieces 309 or 310 through tape 262, as directed along the axis of a toner particle 305, and returns through tape 262 to the other pole piece.

Figure 19:
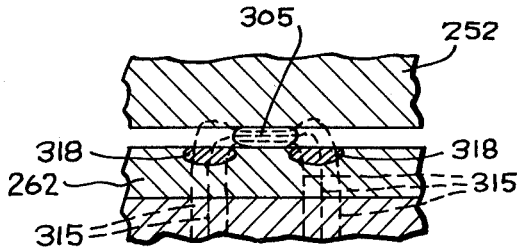
FIG. 19 is a diagrammatic view, partly in section, illustrating the operation of the construction of FIG. 17.

The effect of a single toner particle 305 on a plurality of flux lines 315 is shown in more detail in the enlarged view of FIG. 19. Flux is concentrated or funneled along elongated particle 305 to produce two regions of magnetization 318 in the surface of tape 262 adjacent corresponding ends of particle 305. The magnetic cores of the various arrangements for means 270 are sufficient in length to extend across the width of paper 252 and tape 262.

Figure 20:
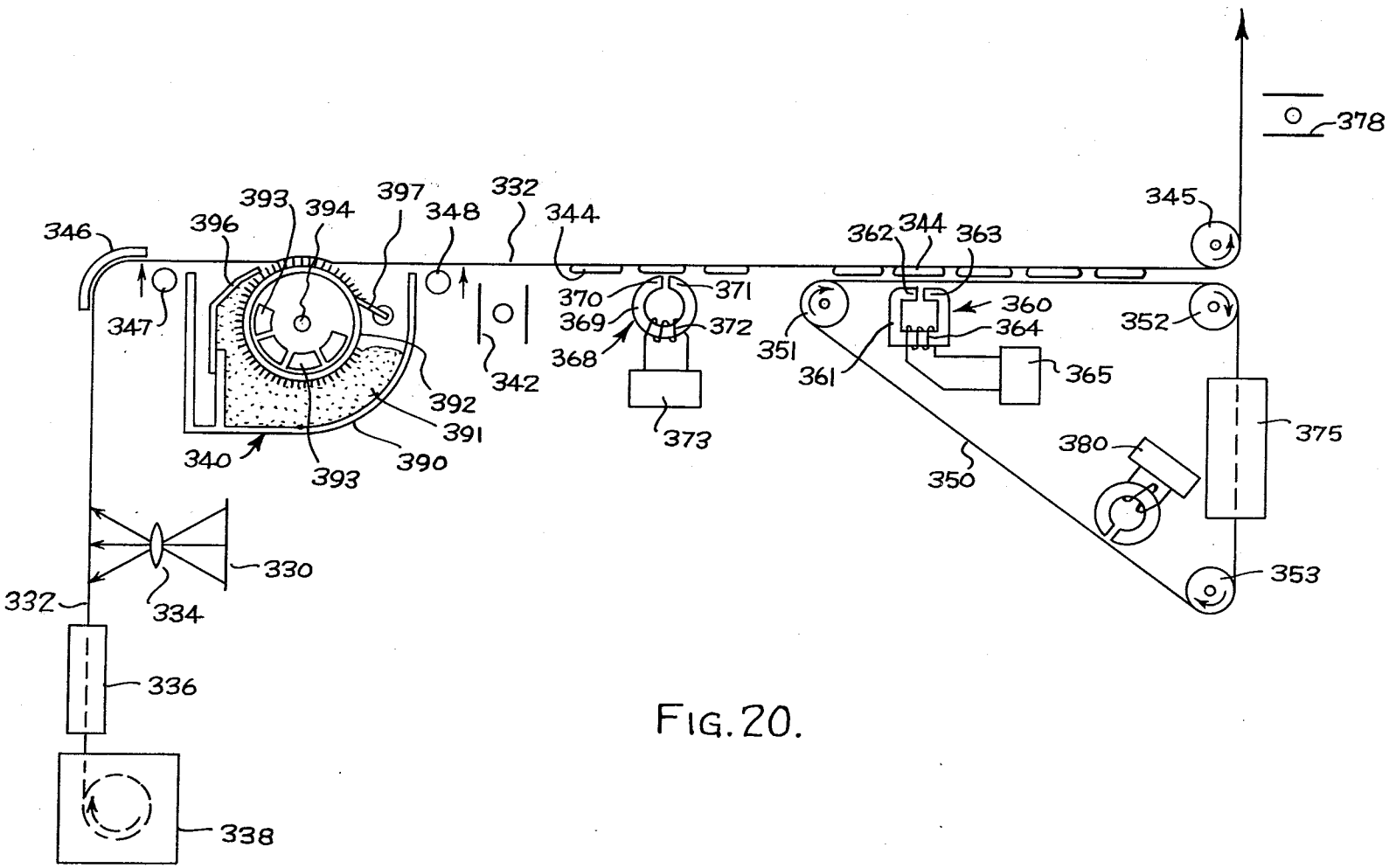
FIG. 20 is a diagrammatic view of a method and apparatus for transferring graphical information according to another embodiment of the present invention.

FIG. 20 illustrates a method and apparatus for transferring graphical information according to another embodiment of the present invention. An optical image of the graphical information from an original medium 330 is transformed to an electrostatic image on an input medium 332, having a surface capable of supporting an electrostatic image, by a lens 334 which directs light rays from medium 330, which may be illuminated, onto the surface of medium 332 and by an electrostatic charging unit 336 which operates on medium 332 prior to its reception of light rays from medium 330. Medium 332 preferably comprises conventional zinc oxide coated paper, which is commonly used in electrostatic printing and copying processes, preferably having a thickness of about 0.003 to 0.0035 inch. Paper 332 is stored in and fed by a suitable means designated generally at 338 in FIG. 20. Charging apparatus 336 is similar in form and operation to apparatus 21 of the embodiment of FIG. 1 and for this reason any further description is deemed to be unnecessary. Also in a manner similar to that of the foregoing embodiments, when more than one copy is to be made, charging apparatus 336 operates only during production of the first copy as will be described in detail hereafter.

The electrostatically charged paper 332 is moved past the image of light rays directed through lens 334 from original 330 and in synchronism with the scan of the original 330. When the light rays reach the outer surface of paper 332 the high lightlevel portions of the image discharge the zinc oxide while the portions of the paper contacted by the low light level portions of the image remain charged. An electrostatic image thus is formed on paper 332 and this image formation likewise is required only during production of the first of a number of duplicate copies as will be described hereafter. The apparatus of the present invention further comprises means, designated generally at 340 in FIG. 20, for applying magnetic toner particles to input medium or paper 332 in a manner such that the toner particles adhere to paper 332 in the form of an image corresponding to the image already present thereon, i.e. to the electrostatic image. In addition, the toner particles preferably are elongated and the means 340 operates to apply the toner particles in alignment, in the same direction relative to each other. Preferably, this direction is parallel to the direction of travel of input medium or paper 332. The construction and operation of means 340 will be described in more detail further on in the specification.

The magnetic material or particles applied by means 340 must be capable of permanent magnetization, and one preferred form of the material is gamma ferric oxide provided with a suitable resinous coating to facilitate subsequent fixing to input medium or paper 332 by a conventional fusing unit designated 342. The magnetic particles after being fused to input medium or paper 332 provide a pattern or image of the graphical information comprising the regions indicated at 344 which are exaggerated in thickness relative to that of paper or medium 332 merely for purposes of illustration. Medium 332 is moved through the apparatus by a suitable arrangement of rollers and drive means in a manner similar to that of the other embodiments, one illustrative roller being shown at 345. A chute 346 guides medium 332 along a portion of its path. The rollers together with suitable drive means (not shown) to which they are coupled and in conjunction with paper feeding means 338 comprise part of the motive means for the apparatus of FIG. 20. A pair of guide rollers 347, 348 are provided for moving medium 332 away from toner applying means 240 when additional copies are produced, as will be described in detail presently.

The apparatus according to this embodiment of the present invention further comprises a recording or storage means 350 having a surface capable of being magnetized. Means 350 comprises an orbitally movable, magnetically retentive member capable of surface magnetization and in the form of an endless tape. Tape 350 preferably comprises a base or substrate of suitable material such as Mylar, having a thickness of about 0.001 to 0.002 inch, and a coating of magnetic material such as gamma ferric oxide, having a thickness of about 0.0005 inch. The width of tape 350 is determined by the width of the copy being made. Tape 350 is trained around a plurality of supporting rollers 351–353 which define the orbit for tape 350, and the three rollers 351–353 together with suitable drive means (not shown) to which they are coupled comprise a part of the motive means for the apparatus of FIG. 20. The motive means operates to cause relative displacement between input medium 332 and storage means 350 and to position input medium 332 into proximity with storage means 350 during a portion of the displacement thereof.

According to this embodiment of the present invention, there is provided means designated generally at 360 for applying a magnetic field to storage means or tape 350 when it is in proximity to input medium or paper 332, having magnetic material 344 thereon to form a magnetic image of the graphical information on the surface of tape 350. In preferred form means 360 comprises a magnetic core 361 having a pair of pole pieces 362, 363 defining a relatively narrow air gap therebetween, and a coil 364 is wound around core 361 and connected to a suitable source of energizing current, indicated generally at 365. The apparatus also includes means 368 for applying a continuous magnetic recording on the magnetic material 344 and preferably before medium 332 and tape 350 are placed in proximity with each other. Means 368 comprises a magnetic core 369 including pole pieces 370, 371 defining therebetween a relatively narrow air gap, and a coil 372 is wound around core 369 and connected to a suitable source of energizing current indicated generally at 373. Each core has a length equal to the width of tape 350.

The apparatus according to this embodiment further comprises means designated generally at 375 for applying magnetic toner particles to storage means or tape 350 in a manner such that the particles adhere to tape 350 in the form of an image corresponding to the magnetic image thereon. Toner applying means 375 can be similar in construction and operation to means 25 shown in FIG. 1. The toner particles applied by means 375 are carried by tape 350 along the orbit thereof for transfer to paper 332 at a portion thereof spaced from the first image thereon in a similar manner to that of the embodiment of FIG. 15–19. The magnetic toner particles applied by means 375 also have a resinous component to facilitate subsequent fixing, and can be of various commercial forms such as Tribofax 213. By virtue of this arrangement, a copy of the original is made and the magnetic image remains on storage means or tape 350 for the production of additional copies in a manner similar to that of the foregoing embodiments.

After paper 332 has received the transferred toner particles it is caused to travel to a conventional fusing unit 378 in FIG. 20 for fixing the toner particles to paper 332. A magnetic erasing or demagnetizing means, designated generally 380, is provided and operates on magnetic tape 350 when the magnetic image or recording thereon is no longer needed, such as when only one copy is wanted or after the desired number of copies has been produced. The apparatus also would include a suitable control system for deactivating the charging means 336 and scanning means, toner applying means 340, and magnetizing means 360, 368 during the production of additional copies, as well as for operating these components during production of the first copy. Rollers 347, 348 preferably would be operable to displace paper 332 away from toner applying means 340 during production of additional copies. While the illustrated apparatus produces the additional copies on spaced subsequent portions of a continuous medium 332, it can of course be modified to produce the additional copies on a separate medium in a manner similar to that of the apparatus of FIG. 1.

To perform the method according to this embodiment of the present invention the apparatus shown in FIG. 20 operates in the following manner. There is formed an electrostatic image of input graphical information from the original medium 330, such as a document, onto the surface of input medium 332, which preferably is zinc oxide coated paper. The formation of the elctrostatic image is performed in a manner similar to that of the foregoing embodiments so that an additional description is deemed to be unnecessary. Then magnetic toner particles are applied by means 340 to the surface of input medium 332 in a manner such that the particles adhere to the surface in correspondence with the electrostatic image. The particles employed are elongated in shape and must be capable of permanent magnetization. In particular, the toner particles applied by means 340 have a magnetic component, an electrostatically attracted component, and a resinous component. Various commercially available forms of toner particles can be employed, and also needle-shaped particles of soft iron provided with a resinous coating can be used. In addition, means 340 operates to apply the elongated toner particles to input medium or paper 332 in a manner such that the particles are aligned in the same direction relative to each other and parallel to the direction of travel of paper 332. The particles then are fixed or fused to medium 332 by means of heater unit 342.

Input medium 332 is moved by rollers 345–348 into proximity with magnetizing means 368 whereupon a continuous magnetic recording is applied to the magnetic material 344. This is accomplished by energizing coil 372 with a relatively low frequency a.c. signal, for example about 500 cycles. The field applied by magnetizing means 368 should have a strength of about 500 to 1000 gauss, the particular value selected depending on the characteristics of tape 350. Magnetization of the magnetic material 344 aligns the magnetic domains within material 344 in preparation for the subsequent magnetization of means 350 which presently will be described. The magnetization of material 344 by means 368 is enhanced by the previous alignment of the magnetic toner particles by means 340. This is because the magnetic recording applied by means 368 is in the form of closely spaced lines of opposite, i.e. north and south, magnetic polarity which lines extend perpendicular to the direction of travel of medium 332. The relatively sharp opposite ends of each elongated toner particle are the portions of the particle most easily magnetized by the adjacent north and south pole line magnetic recordings.

Medium 332 then is moved further through the apparatus and placed in contact with the surface of magnetic storage means or tape 350. The magnetic field or transfer field is applied by means 360 to tape 350 and to the magnetic material 344 or medium 332. The previous alignment of the magnetic domains within material 344 results in a plurality of small magnetic fields produced by the material 344. These fields, in turn, effect magnetization of tape 350 and in accordance with the pattern of graphical information provided by the material 344. The transfer field generated by means 360 functions to overcome the forces within the magnetic material of tape 350 which otherwise would prevent the magnetic domains therein from becoming aligned. Coil 364 is energized by a relatively high frequency a.c. currnet, for example about

100 kilocycles, and the strength of the applied field should be sufficent to overcome the aforementioned forces associated with tape 350 but below the field strength level causing degradation of the recording on magnetic material 344. For example, the field strength can be about 100–200 gauss, the particular value selected being determined by the characteristics of tape 350.

Storage means or tape 350 then is moved further through its orbit, and the magnetic image present thereon is passed through means 375 which applies magnetic toner particles to the image. Tape 350 then moves further through its orbit to bring the toned region thereof into contact with paper 332 on a portion thereof displaced from the inked image previously fused thereon and in a manner similar to that of the embodiment of FIGS. 15–19. The mechanical, frictional transfer of magnetic toner particles from tape 350 to paper 332 is enhanced by a firm contact between the two mediums, and the inked portion of paper 332 is passed by fusing unit 378 whereupon a completed copy results. Storage means or tape 350 can be recycled through toner applying means 375 for a number of times corresponding to the desired number of copies, after which magnetic erase means 380 is operated to remove the magnetic image from tape 350 thereby preparing the tape for receiving a new image.

Toner applying means 340 is shown on FIG. 30 in fragmentary schematic form, and comprises a receptacle 390 containing a mixture 391 of the previously described elongaged magnetic toner particles together with particles which are elongated or needle-shaped, are larger in size than the toner particles, and are magnetically attracted but not electrostatically attracted. For example, these larger particles can be iron filings which are readily commercially available.

Toner applying means 340 further comprises a drum or cylinder 392 of non-magnetic material, for example aluminum. Located within cylinder 392 are a plurality of permanent magnets each designated 393, which extend around a portion of the inner periphery of cylinder 392. Cylinder 392 is rotatably mounted in receptacle 390 and rotated by suitable drive means (not shown) through a shaft 394. Magnets 393, on the other hand, are held fixed with respect to cylinder 392 by a suitable arrangement which can be mounted to housing 390. A first blade means 396 mounted within receptacle 390 has an edge adjustable positioned a relatively short distance from the outer surface of cylinder 392 and near the region of operation on paper 332. A second blade means 397 mounted within receptacle 390 has an edge in scraping or wiping contact with the outer surface of cylinder 392.

In operation, the rotation of cylinder 392, for example in a clockwise direction, together with the magnetic fields produced by magnets 393, causes the iron filings and magnetic toner particles in the mixture 391 to be attracted to the outer surface fo cylinder 392 and carried thereby into contact with the surface of paper 332 travelling over the apparatus 340. In addition, this action agitates the toner particles and develops an electrostatic charge thereon. The thickness of the layer of toner particles carried by cylinder 392 onto paper 332 is controlled by the spacing of blade 396 from the outer surface of cylinder 392. The edge of blade 396 would have the same length as the operative portion of the outer surface of cylinder 392. The iron filings and toner particles are brought into contact with the electrostatically charged surface of paper 332. The iron filings are not attracted to the paper but are retained by cylinder 392, each filing being held at one end thereof to the outer surface of cylinder 392 or to an end of another filing whereby the filings extend generally radially outward. The filings thus function in a matter similar to brush bristles to apply or wipe the elongated magnetic toner particles to the surface of paper 332 and in alignment with each other. The electrostatic attraction of paper 332 for the toner particles is greater than the magnetic attraction of magnets 393 for the toner particles. Blade 397 removes iron filings and residual toner particles remaining on the outer surface of cylinder 392 prior to the next cycle of rotation. A preferred mode of operation is with the speed of cylinder 392 about four times that of the speed of movement of paper 332 relative to apparatus 340. In addition, magnets 393 each provide a field having a strength of about 250 gauss. The mixture comprises, by weight, from about 7 to about 15% toner particles, the remainder being iron filings. For a more detailed description of toner applying means 340, reference may be made to application Ser. No. 163,286, filed July 16, 1971, now abandoned and assigned to the same assignee as the present application.

The method and apparatus of this embodiment of the present invention has the same advantages as those of the embodiment of FIGS. 1, 8 and 15, such as removal of the original from the apparatus during production of additional copies and generation of successive copies at a speed higher than that of the first copy, and provides a relatively high degree of resolution in the copies produced thereby.

While several preferred embodiments of this invention have been hereinabove described and illustrated in the drawings, it is to be understood that numerous modifications thereof can be made without departing from the broad spirit and scope of this invention as defined in the appended claims.

We claim:

1. A method of transferring graphical information from an original medium to a copy medium comprising the steps of:

a. forming an electrostatic image of said graphical information on a surface of a recording means which is magnetizable and capable of supporting electrostatic images;

b. applying magnetic toner particles to a surface of said recording means in a manner such that said particles adhere to said surface in a correspondence with said electrostatic image;

c. forming a magnetic image corresponding to said electrostatic image on a surface of said recording means by utilizing the location of said toner particles on said recording means to influence an applied magnetic field in a manner forming said magnetic image; and d. transferring said toner particles from said recording means to said copy medium while leaving said magnetic image on said recording means.

2. A method according to claim 1 wherein the surface of said recording means capable of supporting electrostatic image is photo-conductive and wherein said step of forming an electrostatic image comprises the steps of:

a. applying an electrostatic charge to said surface of said recording means; and b. directing an optical image of said graphical information onto said surface.

3. A method according to claim 1 wherein said copy medium comprises paper and wherein said step of transferring said toner particles comprises the steps of:

a. placing said paper in contact with the surface of said recording means on which said toner particles are present; and b. causing relative movement between said surface of said recording means and said paper whereby said particles leave said surface and adhere to said paper.

4. A method according to claim 3 further including a step of fixing said toner particles to said paper.

5. A method according to claim 1 further including the steps of:

a. applying magnetic toner particles to the surface of said recording means on which said magnetic image is present in a manner such that said particles adhere to the surface in correspondence with said magnetic image; and b. transferring said toner particles from said recording means to another copy medium while leaving the magnetic image on said recording means.

6. A method according to claim 1 wherein said step of forming a magnetic image comprises the steps of:

a. applying a continuous magnetic recording to said recording means; and b. selectively erasing said recording according to the location of said toner particles on said recording means to form a magnetic image corresponding to the electrostatic image.

7. A method according to claim 6 wherein said step of selectively erasing includes utilizing said magnetic toner particles to provide a magnetic shunt for the applied erase field.

8. A method according to claim 6 wherein said step of applying a continuous recording is done by applying a recording signal in a direction toward the surface of said recording means behind the surface on which said toner particles are present whereby the magnetic recording is present under said toner particles and wherein said step of selectively erasing is done by applying an erasing signal in a direction toward the surface of said recording means on which toner particles are present.

9. A method according to claim 6 wherein said magnetic toner particles include an electrically conductive component and wherein said step of selectively erasing is done by applying a signal of a frequency sufficient to induce eddy currents in said toner particles for deflecting the magnetic flux of the applied erase field around said toner particles.

10. A method according to claim 1 wherein said step of forming a magnetic image is performed by passing said recording means through the air gap between a pair of magnetic pole pieces whereby when said pole pieces are energized said magnetic toner particles reduce the reluctance of the air gap thereby increasing the flux density and concentrating the magnetic flux to form selectively a magnetic recording or image on said recording means under said toner particles.

11. A method according to claim 1 wherein said step of forming an electrostatic image is performed for a number of times, each time for a selected color component of an optical image of said graphical information, and wherein said step of applying magnetic toner particles is performed a corresponding number of times, each time with toner particles of a color identical to said selected color component.

12. A method according to claim 11 wherein electrostatic images of said color components are formed simultaneously on separate recording means and then magnetic toner particles of said colors are applied simultaneously to said separate recording means.

13. A method according to claim 11 wherein electrostatic images of said color components are formed serially on said recording means and then magnetic toner particles of said colors are applied serially to said recording means in a corresponding sequence.

14. A method according to claim 1 wherein said magnetic toner particles are elongated.

15. A method according to claim 6 wherein said magnetic toner particles adhered to said recording means comprise a shield pattern in correspondence with said graphical information which causes a reduction in the flux density of an applied magnetic erasing field of at least about fifty percent.

16. A method according to claim 15 wherein said copy medium comprises paper and is positioned adjacent to said surface of said recording means on which said toner particles are present, and wherein the ratio of the thickness of said toner particles to the thickness of said paper varies between about zero and about one between the areas of said surface of said recording means which are to be erased and the areas of said surface where the recording is to remain.

17. A method according to claim 1, wherein said step of forming a magnetic image comprises applying a magnetic field to said toner particles and to said recording means to magnetize said recording means in areas corresponding to the areas on said recording means where said toner particles are present.

18. A method according to claim 1, wherein said step of forming a magnetic image comprises applying a d.c. or relatively low frequency a.c. magnetic field to said recording means and said toner particles.

19. A method according to claim 1, wherein said step of forming a magnetic image comprises applying a relatively high frequency magnetic field to said recording means.

20. A method according to claim 1, wherein said magnetic toner particles applied to said recording means are elongated and are applied so as to be aligned in a direction parallel to the plane of said surface of said recording means, and wherein a relatively low frequency magnetic field is applied to sid magnetic toner particles on said recording means prior to said step of forming a magnetic image.

* * * * *